US008342888B2

(12) United States Patent
Amleshi et al.

(10) Patent No.: US 8,342,888 B2
(45) Date of Patent: Jan. 1, 2013

(54) CONNECTOR WITH OVERLAPPING GROUND CONFIGURATION

(75) Inventors: Peerouz Amleshi, Lisle, IL (US); John C. Laurx, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/061,325

(22) PCT Filed: Aug. 27, 2009

(86) PCT No.: PCT/US2009/055131

§ 371 (c)(1),
(2), (4) Date: May 9, 2011

(87) PCT Pub. No.: WO2010/025214

PCT Pub. Date: Mar. 4, 2010

(65) Prior Publication Data

US 2011/0212650 A1 Sep. 1, 2011

Related U.S. Application Data

(60) Provisional application No. 61/190,374, filed on Aug. 28, 2008.

(51) Int. Cl.
*H01R 24/00* (2011.01)

(52) U.S. Cl. ..... 439/676; 439/660; 439/941

(58) Field of Classification Search ..... 439/108, 439/660, 676, 941
See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,540,559 | B1 * | 4/2003 | Kemmick et al. | 439/607.05 |
| 7,473,138 | B2 * | 1/2009 | Tuin et al. | 439/607.05 |
| 7,972,180 | B2 * | 7/2011 | Li et al. | 439/660 |
| 2004/0018757 | A1 | 1/2004 | Lang et al. | |
| 2007/0015417 | A1 * | 1/2007 | Caveney et al. | 439/676 |
| 2007/0021004 | A1 * | 1/2007 | Laurx et al. | 439/608 |
| 2007/0059988 | A1 * | 3/2007 | Bolouri-Saransar | 439/676 |
| 2009/0017681 | A1 * | 1/2009 | Amleshi et al. | 439/608 |
| 2009/0017682 | A1 * | 1/2009 | Amleshi et al. | 439/608 |
| 2011/0212650 | A1 * | 9/2011 | Amleshi et al. | 439/660 |

FOREIGN PATENT DOCUMENTS

| | | | |
|---|---|---|---|
| WO | WO 2008/002376 | A2 | 1/2008 |
| WO | WO 2008/156850 | A2 | 12/2008 |

OTHER PUBLICATIONS

International Search Report for PCT/US2009/055131.

* cited by examiner

*Primary Examiner* — James Harvey
(74) *Attorney, Agent, or Firm* — Stephen L. Sheldon

(57) ABSTRACT

A high speed connector (106) with reduced crosstalk utilizes individual connector support frames (121, 122) that are assembled together to form a block of connector units (112). Each such unit supports a column of conductive terminals (113) in two spaced-apart columns. The columns have differential signal terminal pairs separated from each other by larger intervening ground shields that serve as ground terminals. The ground shields are arranged in alternating fashion within the pair of columns and they are closely spaced together so as to define within the pair of columns, a serpentine pattern of ground shields that cooperate to act as a single "pseudo" shield within each pair of columns. The ground shields are substantially larger in width (GW) than the differential signal terminal pairs (SPW) to provide more effective signal isolation.

13 Claims, 29 Drawing Sheets

FIG.11A

Cross Talk Pin Map Example

| | 1 | 2 | 3 | 4 | 5 | 6 | 7 | 8 | 9 | 10 |
|---|---|---|---|---|---|---|---|---|---|---|
| A | G | S | G | S | G | S | G | S | G | S |
| B | S | S | S | S | S | S | S | S | S | S |
| C | S | G | S | G | S | G | S | G | S | G |
| D | G | S | G | S | G | S | G | S | G | S |
| E | S | S | S | S | S | S | S | S | S | S |
| F | S | G | S | G | S | G | S | G | S | G |
| G | G | S | G | S | G | S | G | S | G | S |
| H | S | S | S | S | S | S | S | S | S% | S |
| J | S | G | S | G | S | G | S | G | S% | G |
| K | G | S | G | S | G | S | G | S% | G | S* |
| L | S | S | S | S | S | S | S | S% | S | S* |
| M | S | G | S | G | S | G | S | G | S | G |
| N | G | S | G | S | G | S | G | S* | G | S% |
| O | S | S | S | S | S | S | S | S* | S% | S% |
| P | S | G | S | G | S | G | S | G | S% | G |

G Ground

S S Victim

S% S% Aggressor Measured

S* S* Aggressor

Worst Case Crosstalk for Victim Pair L9M9

| | $T_{rise}$ = 33ps (20–80%) | |
|---|---|---|
| | %NEXT | %FEXT |
| Aggressors | | |
| H9J9 | 0.38 | 0.28 |
| O9P9 | 0.33 | 0.45 |
| K8L8 | 0.40 | 0.20 |
| N10O10 | 0.68 | 0.23 |
| N8O8 | 0.68 | 0.23 |
| K10L10 | 0.40 | 0.20 |
| Total | %2.87 | %1.59 |

CONNECTOR WITH OVERLAPPING GROUND CONFIGURATION

REFERENCE TO RELATED APPLICATIONS

This application is a national phase of PCT Application No. PCT/US09/55131, filed Aug. 27, 2009, which in turn claims priority to U.S. Provisional Application Ser. No. 61/190,374, filed Aug. 28, 2008, which is incorporated herein by reference in its entirety

BACKGROUND OF THE INVENTION

The present invention relates generally to high speed connectors, and more particularly to high speed backplane connectors, with reduced crosstalk and improved performance.

High speed connectors are used in many data transmission applications particularly in the telecommunications industry. Signal integrity is an important concern in the area of high speed and data transmission for components need to reliably transmit data signals. The high speed data transmission market has also been driving toward reduced size components and increased signal density.

High speed data transmission is utilized in telecommunications to transmit data received from a data storage reservoir or a component transmitter and such transmission most commonly occurs in routers and servers. As the trend of the industry drives toward reduced size, the signal terminals in high speed connectors must be reduced in size and to accomplish any significant reduction in size, the terminals of the connectors must be spaced closer together. As signal terminal are positioned closer together, signal interference increases between closely spaced signal terminals especially between pairs of adjacent differential signal terminals. This is referred to in the art as "crosstalk" and it occurs when the electrical fields of signal terminals overlap each other. At high speeds the signal of one differential signal pair may couple to an adjacent, or nearby differential signal pair. This degrades the signal integrity of the entire signal transmission system. The reduction of crosstalk in high speed data systems is a key goal in the design of high speed connectors.

Previously, reduction of crosstalk was accomplished primarily by the use of inner shields positioned between adjacent sets of differential signal terminals. These shields were relatively large metal plates that act as an electrical field barrier, between rows or columns of differential signal terminals. These shields add significant cost to the connector and also increase the size of the connector. The shields may also increase the capacitive coupling of the signal terminals to ground and thereby lower the impedance of the connector system. If the impedance is lowered because of the inner shields, care must be taken to ensure that it does not exceed, or fall, below a desired value at that specific location in the connector system. The use of shields to reduce crosstalk in a connector system requires the system designer to take into account the effect on impedance and the effect on the size of the connector of these inner shields.

Some have tried to eliminate the use of shields and rely upon individual ground terminals that are identical in shape and dimension to that of the differential signal terminals with which they are associated. The use of ground terminals similarly sized to that of the signal terminals requires careful consideration to spacing of all the terminals of the connector system throughout the length of the terminals. In the mating interface of high speed connector, impedance and crosstalk may be controlled due to the large amounts of metal that both sets of contacts present. It becomes difficult to match the impedance within the body of the connector and along the body portions of the terminals in that the terminal body portions have different configurations and spacing than do the contact portions of the terminals.

The present invention is therefore directed to a high speed connector that overcomes the above-mentioned disadvantages and which uses a plurality of larger, individual shields for each differential signal pair to control crosstalk and reduce resonance, and in which the individual shield cooperatively act as a single shield with the terminal array and along the terminal body portions of the connector.

SUMMARY OF THE INVENTION

The present invention accomplishes these and other objects by virtue of its unique structure. In one principal aspect, the present invention encompasses a backplane connector that utilizes a header connector intended for mounting on a backplane and a right angle connector intended for mounting on a daughter card. When the two connectors are joined together, the backplane and the daughter card are joined together, typically at a right angle.

The right angle connector, which also may be referred to as a daughter card connector, is formed from a series of like connector units. Each connector unit has an insulative frame formed, typically molded from a plastic or other dielectric material. This frame supports a plurality of individual connector units, each supporting an array of conductive terminals. Each connector unit frame has at least two distinct and adjacent sides, one of which supports terminal tail portions and the other of which supports the terminal contact portions of the terminal array. Within the body of the daughter card connector, the frame supports the terminals in a columnar arrangement, or array, so that each unit supports a pair of terminal columns therein.

Within each column, the terminals are arranged so as to present isolated differential signal pairs. In each column, the differential signal terminal pairs are arranged edge to edge in order to promote edge (differential mode) coupling between the differential signal terminal pairs. The larger ground shield terminals are first located in an adjacent column directly opposite the differential signal terminal pair and are secondly located in the column adjacent (above and below) the differential signal terminal pairs. In this manner, the terminals of each differential signal terminal pair within a column edge couple with each other but also engage in broadside coupling to the ground shield terminals in adjacent columns facing that differential signal terminal pairs. Some edge coupling, which is also common mode coupling, occurs between the differential signal terminal pairs and the adjacent in the ground shield terminals. The larger ground shield terminals, in the connector body, may be considered as arranged in a series of inverted V-shapes, which are formed by interconnecting groups of three ground shield terminals by imaginary lines and a differential signal terminal pair is nested within each of these V-shapes.

The frame is an open frame that acts as a skeleton or network, that holds the columns of terminals in their preferred alignment and spacing. In this regard, the frame includes at least intersecting vertical and horizontal parts and at least one bisector that extends out from the intersection to divide the area between the vertical and horizontal members into two parts. Two other radial spokes subdivide these parts again so that form district open areas appear on the outer surface of each of the connector unit wafer halves. This network of radial spokes, along with the base vertical and horizontal members, supports a series of ribs that provide a mechanical backing for the larger ground shield terminals. The spokes are also preferably arranged so that they serve as a means for transferring the press-in load that occurs on the top of the daughter card connector to the compliant pin tail portions during assembly of the daughter card connector to the daughter card.

The radial spokes are continued on the interior surface of one of the connector unit wafer halves and serves as standoffs to separate the columns of terminals when the two connector unit wafer halves are married together so that an air spacing is present between the columns of terminals. The signal and larger ground shield terminals make at least two bends in their extent through the connector body and in these bend areas, the impedance of the connector units is controlled by reducing the amount of metal present in both the differential signal terminal pair and in their associated ground shield terminals. This reduction is accomplished in the ground shield terminals by forming a large window and in the signal terminal by "necking" or narrowing the signal terminal body portions down in order to increase the distance between the signal terminal edges.

This modification is also implemented present in other areas within the connector unit, where the wafer halves are joined together. The connector unit wafer halves are joined together in the preferred embodiment by posts formed on one wafer half that engage holes formed on the other wafer half. The above-mentioned windows are formed in the large ground shield terminals, in line with the support spokes of the support frame, and the posts project through these openings. The necked down portions of the differential signal terminal pairs are also aligned with the support spokes of the connector unit support frame and the ground shield terminal windows. In this manner, broadside coupling of the differential signal terminal is diminished with the ground shield terminals at this area.

In another important aspect of the present invention, the larger ground terminals are made substantially larger in width than the pair signal terminals, ranging from about 2.5 times to about 3.5 times wider than the width of the pairs of the signal terminals, the signal pair width including the spacing between the pair of signal terminals. With this increased width, better signal isolation is provided, especially in the mating interface of the connector unit. For the increased widths of the ground terminals defines an overlap of the ground terminals which narrows the available path for crosstalk between adjacent differential signal terminal pairs. The wider ground terminals are backed by portions of the connector unit frame to provide a measure of structural support as well as a dielectric member along the length of the ground terminals.

The wide ground terminals may be contacted together at one or more locations along their lengths. This contact, or commoning, preferably occurs near the edges of the connector unit frames within the areas of the ground terminal that overlap each other. These points of contact create additional paths for the current and electrical energy to drain during operation of the connector. This commoning contact is made proximate to the mating and mounting interfaces, and may be effected by punching or stamping a contact member in the form of a tab in selected ground terminals of one of the two arrays of terminals of each connector unit. The contact tabs are bent away from the ground terminals and toward the ground terminal of the adjacent terminal array. The contact tabs have a length sufficient so that reliable contact is made between the contact tabs and the ground terminals when the two halves of the connector unit are brought together and paced within the connector housing. The contact tabs may be provided in their location as pairs, one tab on each side of the rib that extends along the back of the ground terminal.

A transition is provided where the terminal tail portions meet the terminal body portions, so as to create a uniform mounting field for the terminal tail portions. In this regard, the tail ends of terminal body portions extend outwardly from their location adjoining the centerline of the connector unit, and toward the sides of the connector units so as to achieve a desired, increased width between the terminal tail portions of the two columns so that the tail portions are at a certain pitch, widthwise between columns. In order to achieve a desired depth between the terminal tail portions within each column, the ends of the terminal body portions near the terminal tail portions shift in the lateral direction along the bottom of the connector unit support frame, so that the tail portions are arranged in a uniform spacing, rather than in an uneven spacing were the tail portions to be centered with the ends of the terminal body portions. These and other objects, features and advantages of the present invention will be clearly understood through a consideration of the following detailed description.

BRIEF DESCRIPTION OF THE DRAWINGS

In the course of this detailed description, [the] reference will be frequently made to the attached drawings in which:

FIG. 11A is a crosstalk pin map of the connector of FIG. 1, identifying the rows and columns of terminals by alpha and numerical designations, respectively and identifying actual crosstalk obtained from testing of a connector of the present invention;

DETAILED DESCRIPTION OF THE PREFERRED EMBODIMENTS

Figure 1:
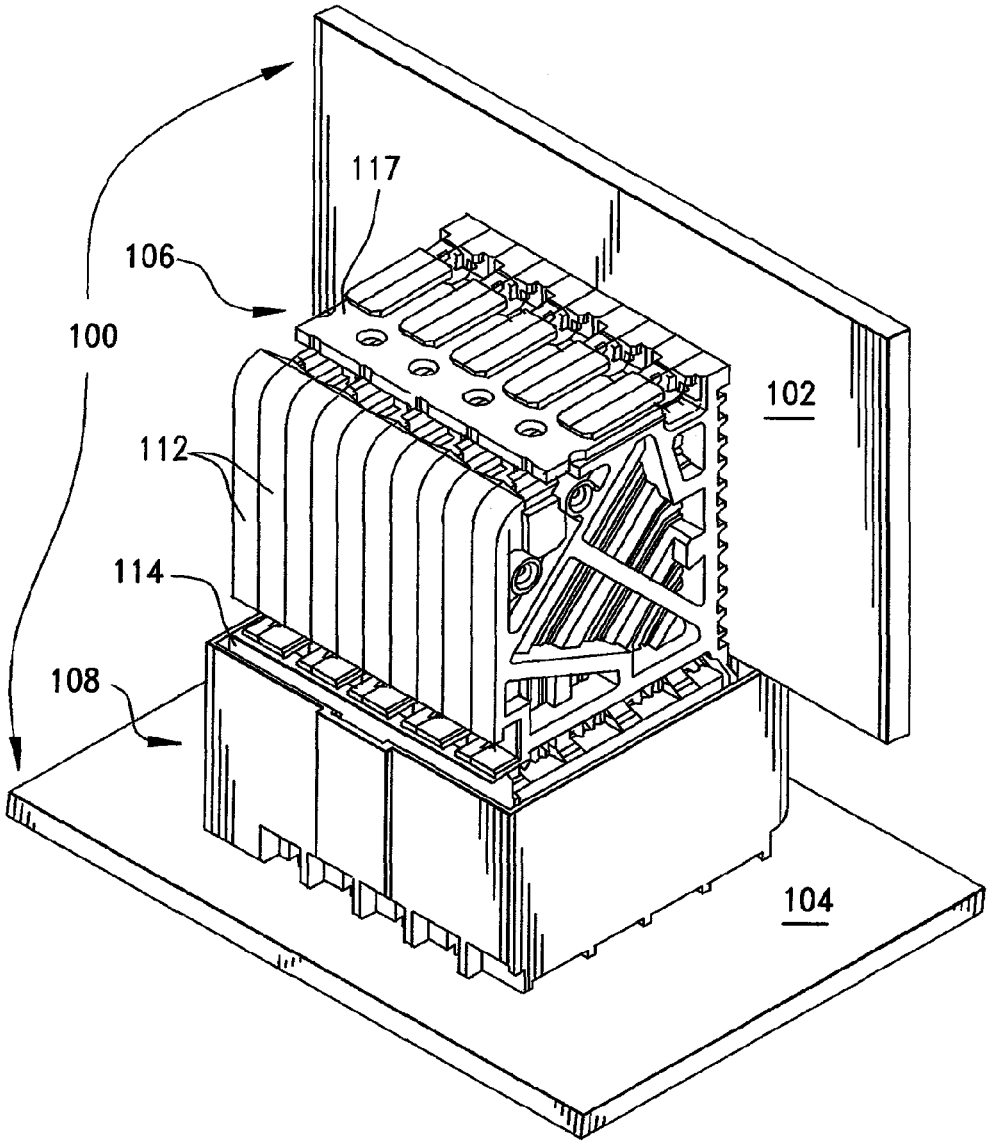
FIG. 1 is a perspective view of a backplane connector assembly constructed in accordance with the principles of the present invention in which a daughter card connector mates with a pin header to interconnect two circuit boards together.

As required, detailed embodiments are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the depicted features in virtually any appropriate manner, including employing various features disclosed herein in combinations that might not be explicitly disclosed herein.

It has been determined that certain depicted features can be used to provided an improved connector for high speed data transmission which has reduced crosstalk and which does not require large metal shields interposed between groups of signal terminals. This can be helped if each differential signal pair being flanked by an associated ground shielded terminal in an adjacent column, the ground shield terminal having dimensions greater than that of one of the differential signal terminals so as to provide a large reference ground in close proximity to the differential signal pair so as to permit the differential signal pair to broadside couple to the individual ground shield facing it.

In an embodiment, a connector can utilize a plurality of differential signal terminal pairs to effect data transmission, wherein the differential signal terminal pairs are arranged in a "triad" configuration in association with an enlarged ground terminal, and the terminals are arranged in two adjacent columns within a single connector unit, the enlarged ground terminals acting as individual ground shields, the ground shields in one column being spaced apart from and aligned with a differential signal terminal pair in the other column of the connector unit, the ground shields being staggered in their arrangement within the two columns and being closed spaced together such that they cooperatively act as a single, or "pseudo" ground shield in each connector unit. A connector of the type described above where the ground shields in each pair of columns within each connector unit trace a serpentine path through the body portion of the connector unit from the top of the connector unit to the bottom thereof and can provide enhanced isolation from crosstalk.

To provide desired improvements, a high speed connector for use in backplane applications at speeds of between about 5 GBsecs and about 30 Gbsecs with upwards to 40 GBsecs has a plurality of connector units and each unit is formed from two opposing halves, with each half supporting a plurality of conductive terminals in a ground-signal-signal-ground arrangement in which the two signal terminals constitute a differential signal terminal pair. The ground terminals have a greater width than the width of the differential signal terminal pair such that tangents drawn along edges of the ground terminals intersect with the ground terminals in adjacent terminal arrays. A structure that promotes reduced resonance at high data transfer speeds can be configured so that adjacent ground terminals within each connector unit are commoned together at one or more discrete locations along the length of the ground terminals, preferably near the mating and mounting interfaces thereof in order to provide more return paths for currents induced in the grounds. In an embodiment such commoning can be provided by way of contact tabs that extend out from one array of terminals in opposition and into contact with the ground terminals in the adjacent array of terminals.

Figure 2:
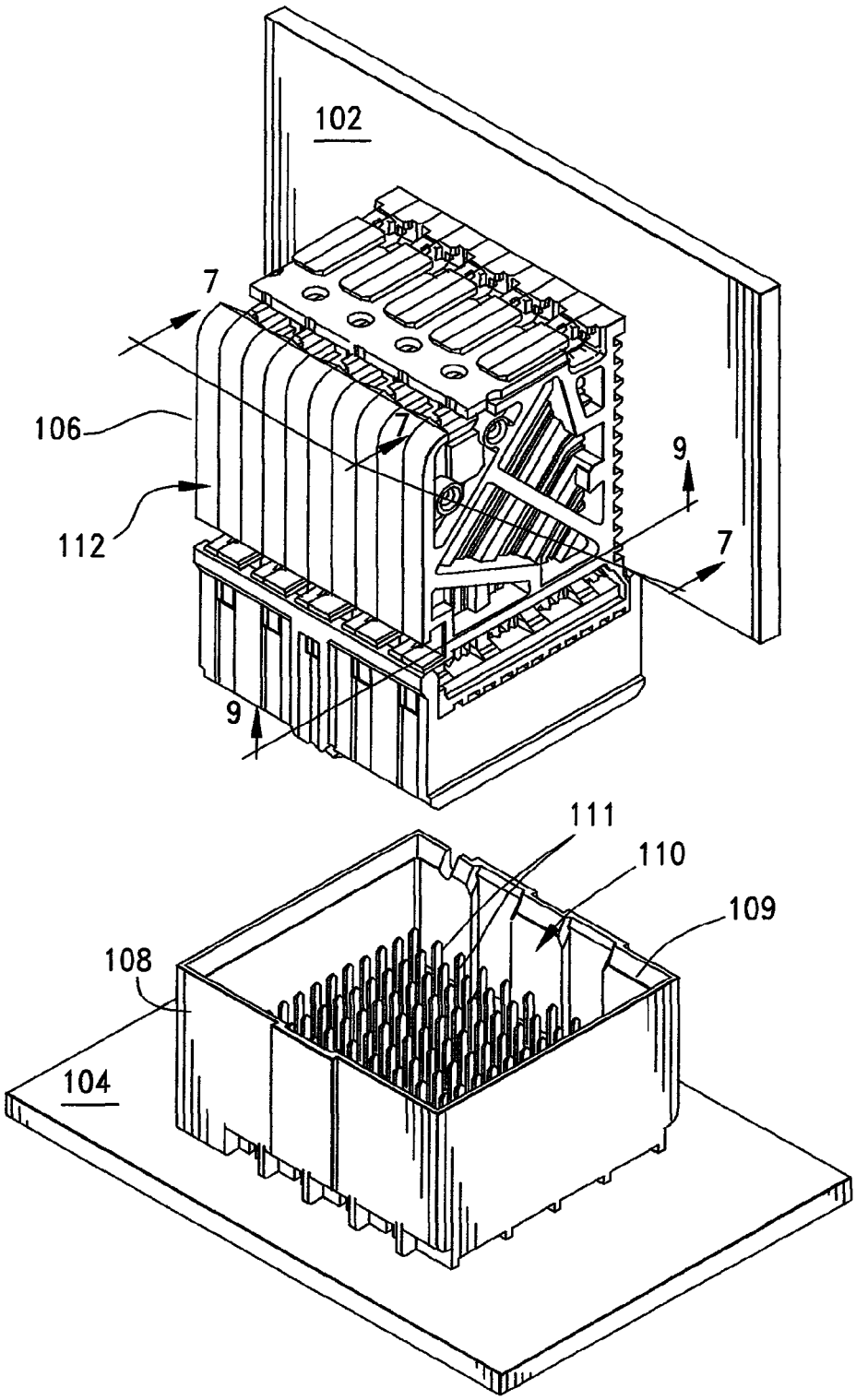
FIG. 2 is the same view as FIG. 1, but illustrating the daughter card connector removed from the backplane pin header.

Turning to the figures, FIG. 1 illustrates an embodiment of a backplane connector assembly 100 which is used to join an auxiliary circuit board 102, known in the art as a daughter card, to another circuit board 104, typically referred to in the art as a backplane. The assembly 100 includes two connectors 106 and 108. As shown best in FIG. 2, the backplane connector 108 takes the form of a pin header having four sidewalls 109 that cooperatively define a hollow receptacle 110. A plurality of conductive terminals in the form of pins 111 are provided and held in corresponding terminal-receiving cavities of the connector 108 (not shown). The pins 111 are terminated, such as by tail portions to conductive traces on the backplane 104 and these tail portions fit into plated vias, or through holes, disposed in the backplane.

Figure 3:
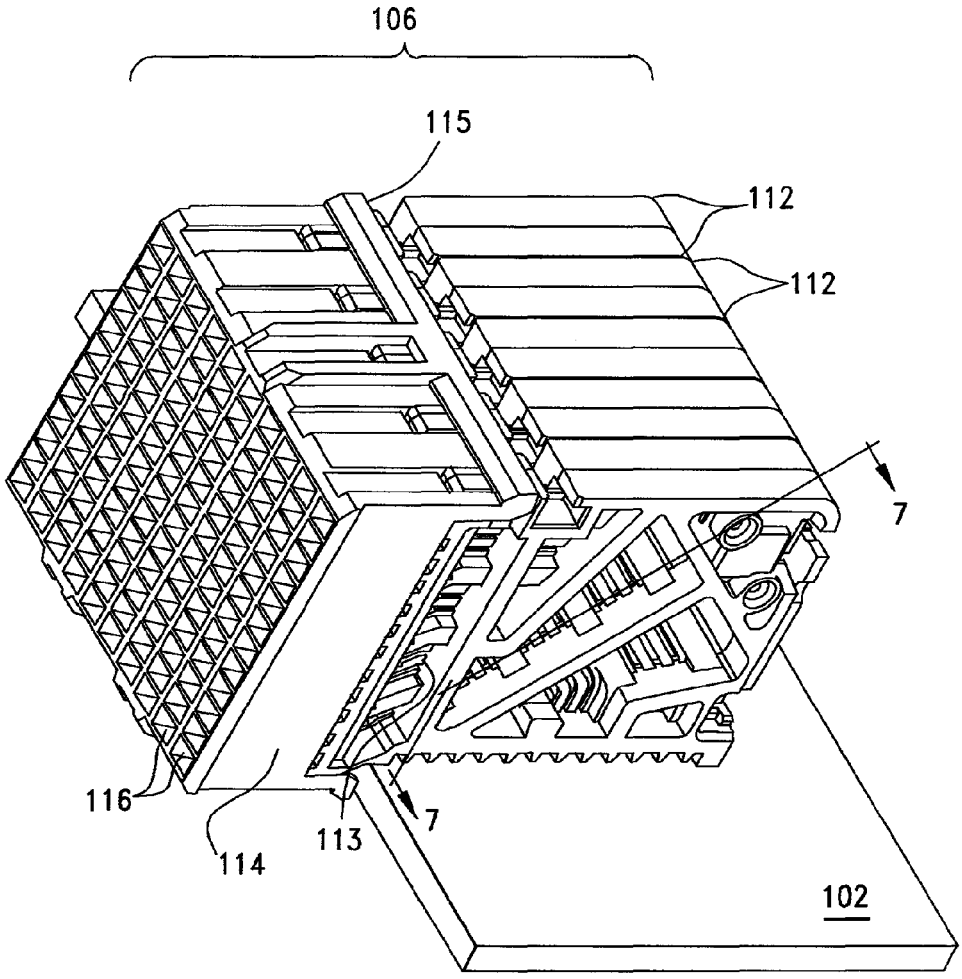
FIG. 3 is a perspective view of the daughter card connector of FIG. 2, at a different angle thereof, illustrating it with a front cover, or shroud, applied to the individual connector units.

Turning to FIG. 3, the daughter card connector 106 is composed of a plurality of discrete connector units 112 that house conductive terminals 113 with tail portions 113*a* and contact portions 113*b* (FIG. 4) disposed at opposite ends of the terminals. The terminal contact portions 113*b* are joined to the terminal tail portions 113*a* by intervening body portions 113*c*. These body portions 113*c*, extend, for the most part through the body portion of the connector unit, from approximately the base frame member 131 to the additional vertical frame member 135. The connector units 112 have their front ends 115 inserted into a hollow receptacle formed within a front cover, or shroud, 114. (FIG. 3) The shroud 114 has a plurality of openings 116 aligned with the pins 111 of the backplane connector 108, so that when the daughter card connector 106 is inserted into the backplane connector 108, the pins are engaged by the contact portions 113*b* of the terminals 113 of the daughter card connector 106. The connector units 112 may be further held together with a stiffener, or brace 117 that is applied to the rear surfaces 118 of the connector units 112.

Figure 8A:
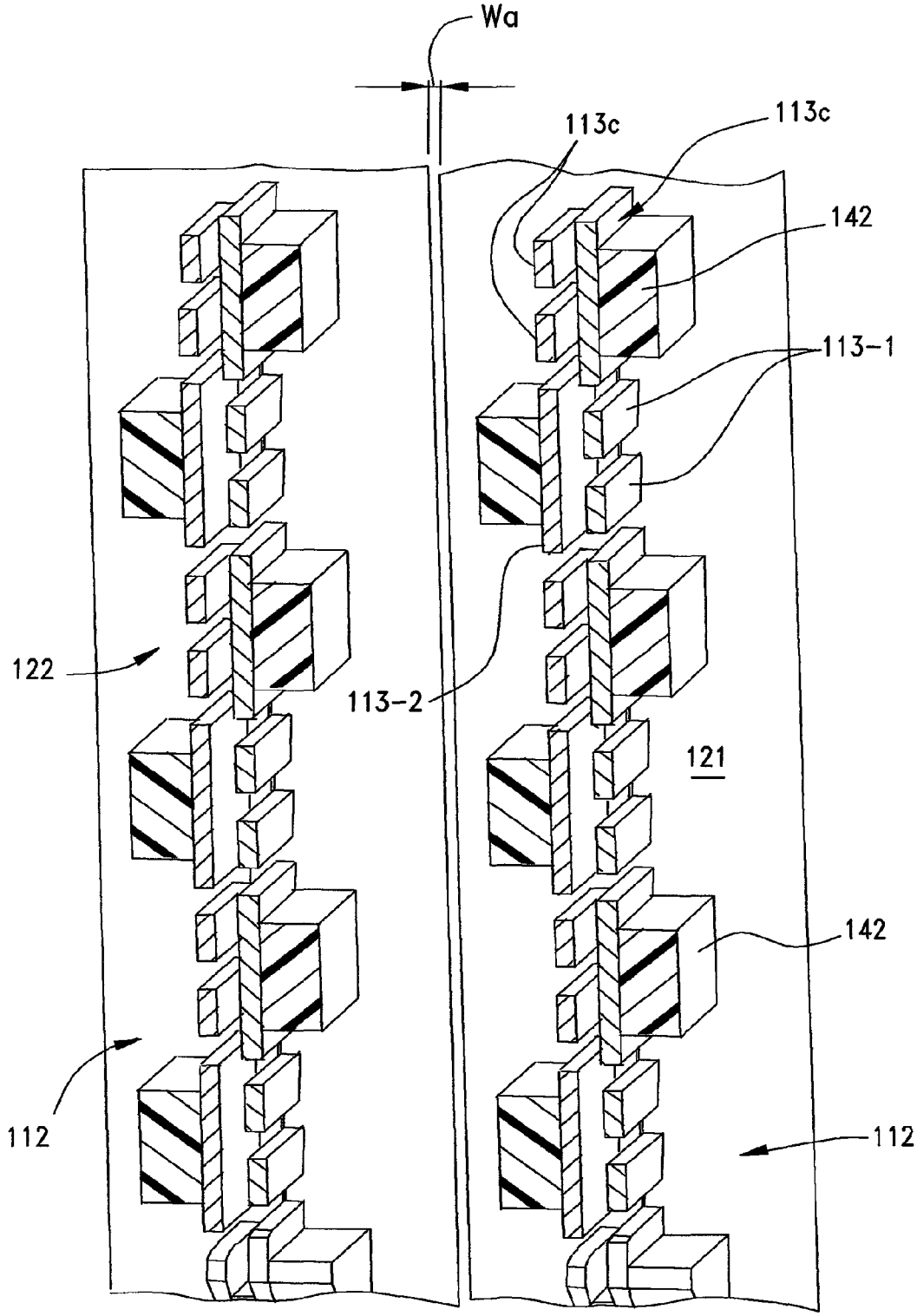
FIG. 8A is a slight perspective view of the sectioned face of the daughter card connector of FIG. 7, illustrating two adjacent connector units, or wafers.
Figure 8B:
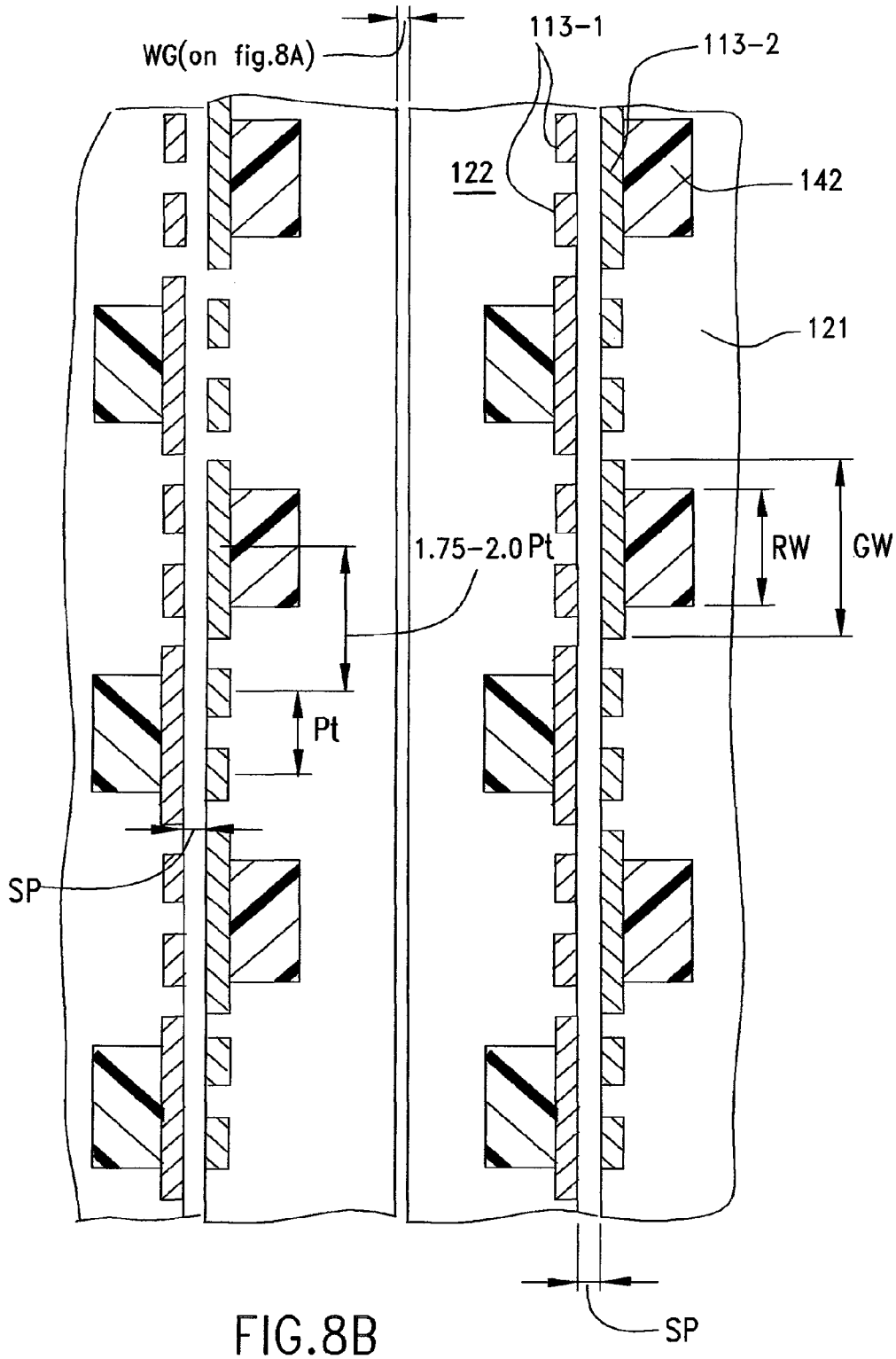
FIG. 8B is a front elevational view of FIG. 8A.

Each connector unit 112, in an embodiment, takes the form of a wafer that is formed by the wedding, or marriage, of two waflets or halves 121, 122 together. The right hand wafer half 122 is illustrated open in FIG. 5A, while the left hand wafer halve 121 is shown open in FIG. 5B. Each wafer half 121, 122 holds an array of conductive terminals 113 in a particular pattern. The array of terminals defines a "column" of terminals in the wafer half when viewed from the mating end, i.e. the end of the wafer half that supports the terminal contact portions 113*b*. Thus, when two wafer halves are mated together each wafer, or connector unit, 112 supports a pair of columns of terminals 113 that are spaced apart widthwise within the connector unit 112. This spacing is shown in FIG. 8B as "SP" and is provided by the interior spokes 133', 135', 137', 139, 139' and 140' shown in FIG. 5A. For reliability, the contact portions 113*b* of the terminals 113 are provided with pairs of contact arms as shown in the drawings. This bifurcated aspect ensures that the daughter card connector terminals will contact the backplane connector pins even if the terminals are slightly misaligned.

Figure 7:
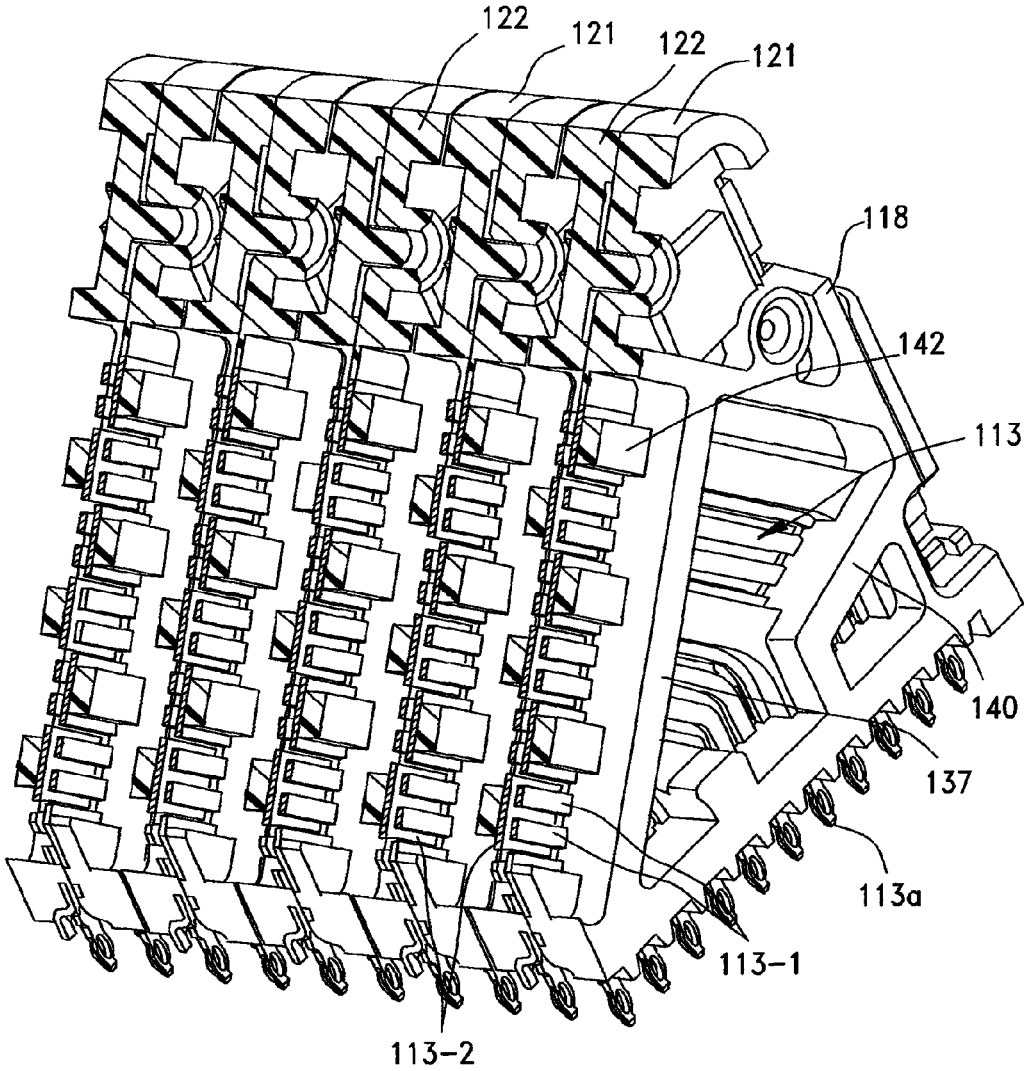
FIG. 7 is a sectional view of the daughter card connector of FIG. 2 or 3, taken along lines 7-7 thereof to expose the terminal body portions and to generally illustrate the "triad" nature of the differential signal pairs utilized in each connector unit.
Figure 7A:
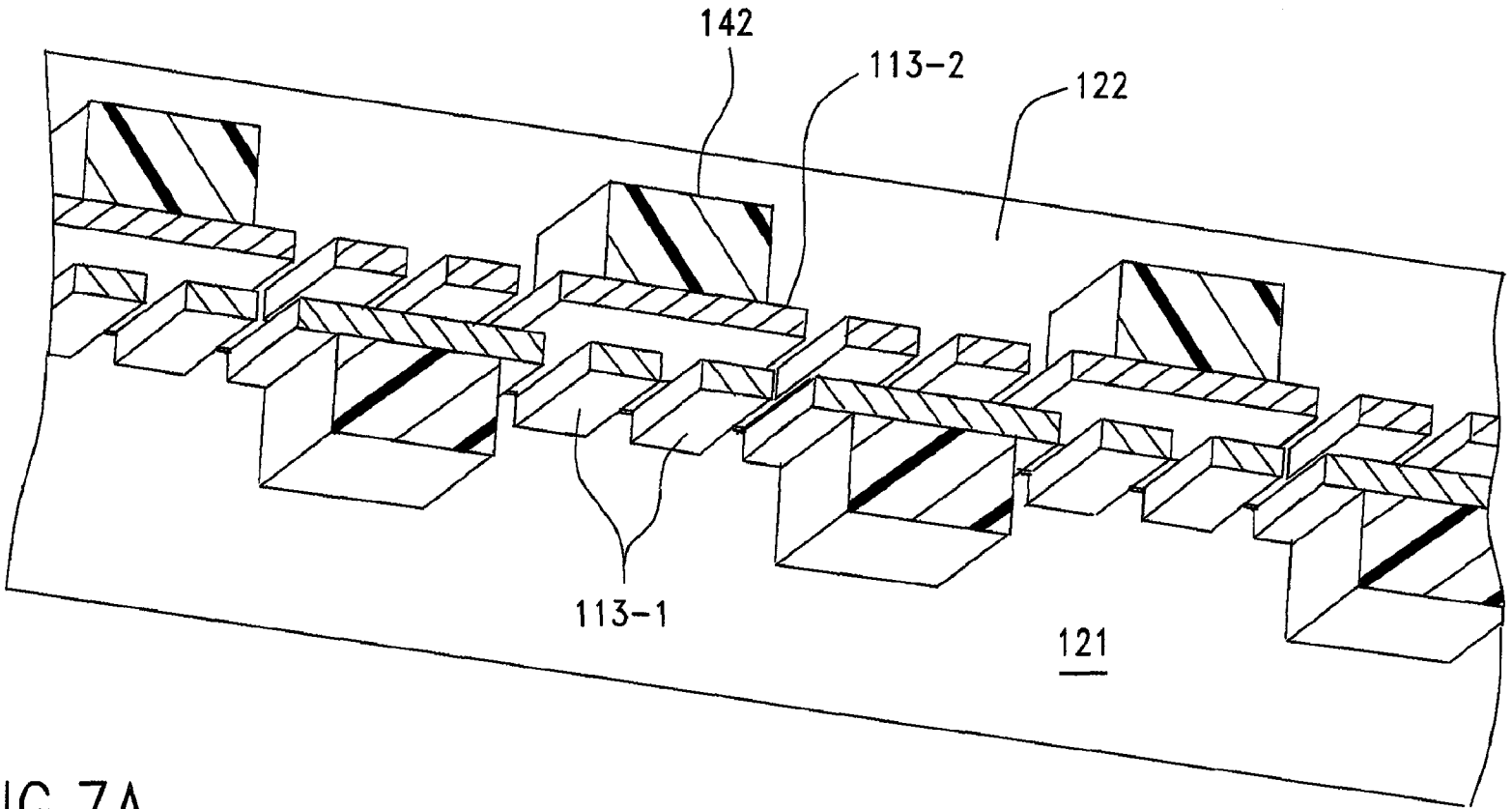
FIG. 7A is an enlarged, detailed view of one wafer of the sectioned daughter card connector of FIG. 7, specifically illustrating the "triad" nature of the terminal body portions of the daughter card connector unit.
Figure 7B:
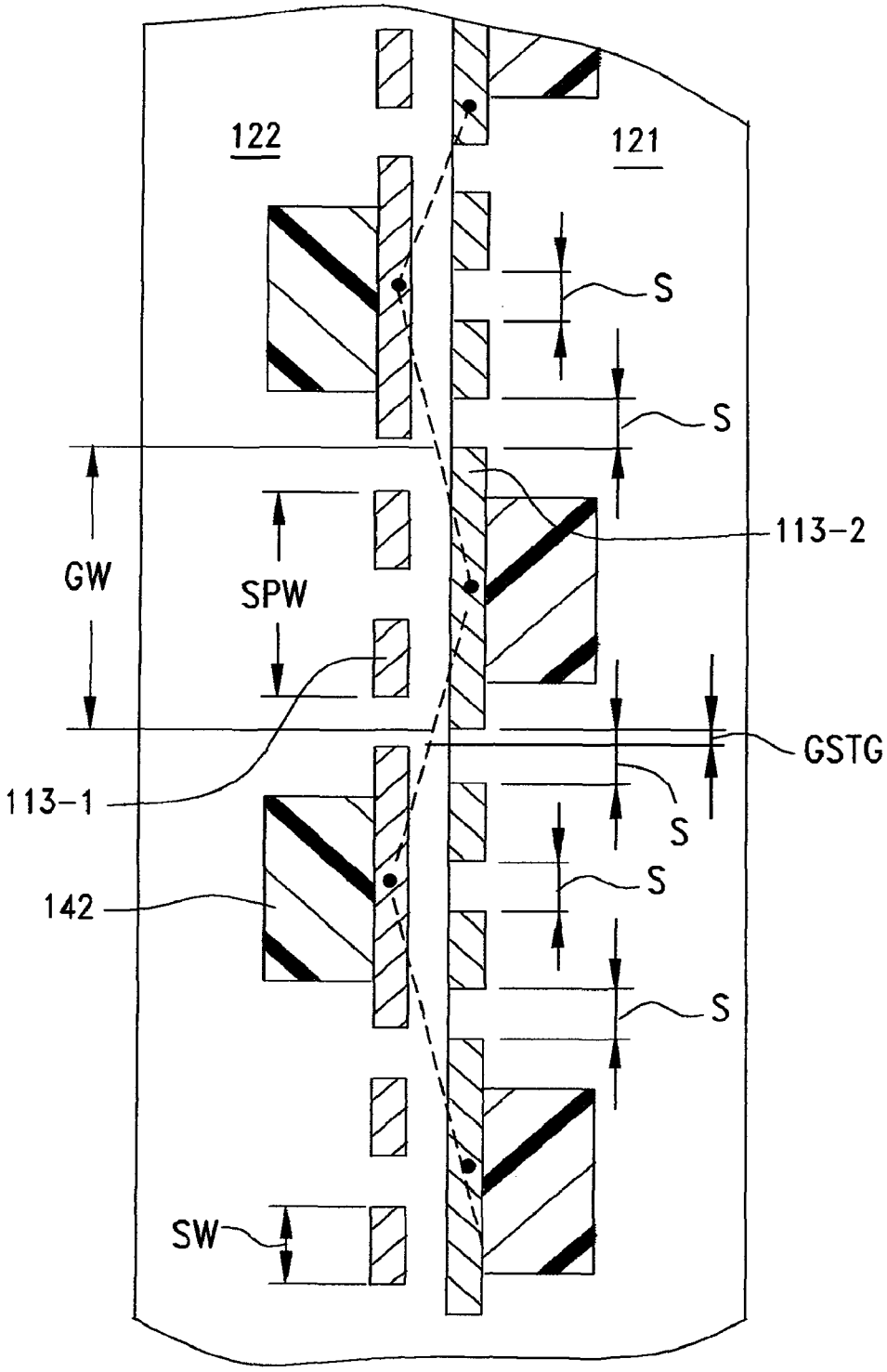
FIG. 7B is a front elevational view of the detailed view of FIG. 7A.

In an embodiment, the terminals 113 are separated into distinct signal terminals 113-1 and ground shield terminals 113-2. The ground shield terminals 113-2 are used to mechanically separate the signal terminals into signal terminal pairs across which differential signal will be carried when the connectors are operated. The ground shield terminals 113-2 are larger in size than each individual signal terminal 113-1 and are also larger in surface area and overall dimensions than a pair of the signal terminals 113-1 and as such, each such ground shield terminal 113-2 may be considered as an individual ground shield disposed within the body of the connector unit 112. The dimensions and arrangement of the signal and ground shield terminals are best shown in FIG. 7B, where it can be seen that within each wafer halve, the ground shield terminals 113-2 are separated from each other by intervening spaces. These spaces contain a pair of signal terminals 113-1, which are aligned with the ground shield terminals 113-2 so that all of the terminals 113 are arranged substantially in a single line within the column of terminals. The signal terminals are arranged on a pitch Pt, while the ground shield terminals are spaced apart from the signal terminals on a centerline spacing equal to about 1.75-2.0 Pt.

These signal terminals 113-1 are intended to carry differential signals, meaning electrical signals of the same absolute value, but different polarities. In order to reduce cross-talk in a differential signal application, it is wise to force or drive the differential signal terminals in a pair to couple with each other or a ground(s), rather than a signal terminal or pair of terminals in another differential signal pair. In other words, it is desirable to "isolate" a pair of differential signal terminals to reduce crosstalk at high speeds. This is accomplished, in part, by having the ground shield terminals 113-2 in each terminal array in the wafer halves offset from each other so that each pair of signal terminals 113-1 opposes, or flanks, a large ground terminal 113-2. Due to the size of the ground shield terminal 113-2, it primarily acts as an individual ground shield for each differential signal pair that it faces within a wafer (or connector unit). The differential signal pair couples in a broadside manner, to this ground shield terminal 113-2. The two connector unit halves 121, 122 terminal columns are separated by a small spacing, shown as SP in FIGS. 8A and 8B, so that for most of their extent through the connector unit, the terminals in one column of the connector unit are separated from the terminals in the other column of the connector unit by air with a dielectric constant of 1. The ground shield terminal 113-2 also acts, secondarily, as a ground shield to the terminals of each differential signal pair 113-1 that lie above and below it, in the column or terminals (FIG. 7B). The nearest terminals of these differential signal terminal pairs edge couple to the ground shield terminal 113-2. The two terminal columns are also closely spaced together and are separated by the thickness of the interior spokes, and this thickness is about 0.25 to 0.35 mm, which is a significant reduction in size compared to other known backplane connectors.

Such a closely-spaced structure promotes three types of coupling within each differential signal channel in the body of the daughter card connector: (a) edge coupling within the pair, where the differential signal terminals of the pair couple with each other; (b) edge coupling of the differential signal terminals to the nearest ground shield terminals in the column of the same wafer half; and, (c) broadside coupling between the differential signal pair terminals and the ground shield terminal in the facing wafer half. This provides a localized ground return path that may be considered, on an individual signal channel scale, as shown diagrammatically in FIG. 7B, as having an overall V-shape when imaginary lines are drawn through the centers on the ground shield terminal facing the differential signal pair into intersection with the adjacent ground shield terminal that lie on the edges of the differential signal pair. With this structure, each differential signal terminal pair can have a combination of broadside and edge coupling and the combination can help constrain the differential signal terminal pair into better differential mode coupling within the signal pair.

On a larger, overall scale, within the body of the connector, these individual ground shield terminals further cooperatively define a serpentine pseudo-ground shield within the pair of columns in each wafer. By use of the term "pseudo" is meant that although the ground shield terminals 113-2 are not mechanically connected together, they are closely spaced together both widthwise and edgewise, so as to electrically act as if there were one shield present in the wafer, or connector unit. This extends throughout substantially the entire wafer where the ground shield terminal 113-2 is larger than the signal terminals 113-1, namely from the bottom face to the vertical support face. By "larger" is meant both in surface area and in terminal width. FIG. 7B illustrates this arrangement best. The opposing edges of the ground shield terminals may be aligned with each other along a common datum line or as shown in FIG. 7B, there may be a gap GSTG disposed between the edges of the adjacent grounds, and this gap has a distance that is preferably 7% or less of the width GW of the ground shield terminal.

The ground shield terminal 113-1 should be larger than its associated differential signal pair by at least about 15% to 40%, and preferably about 34-35%. For example, a pair of differential signal terminals may have a width of 0.5 mm and be separated by a spacing of 0.3 mm for a combined width, SPW, of 1.3 mm, while the ground shield terminal 113-2 associated with the signal pair may have a width of 1.75 mm. The ground shield terminals 113-2 in each column are separated from their adjacent signal terminals 113-1 by a spacing S, that is preferably equal to the spacing between signal terminals 113-1, or in other words, all of the terminals within each column of each wafer half are spaced apart from each other by a uniform spacing S that establishes a preferred coupling mode.

Figure 10A:
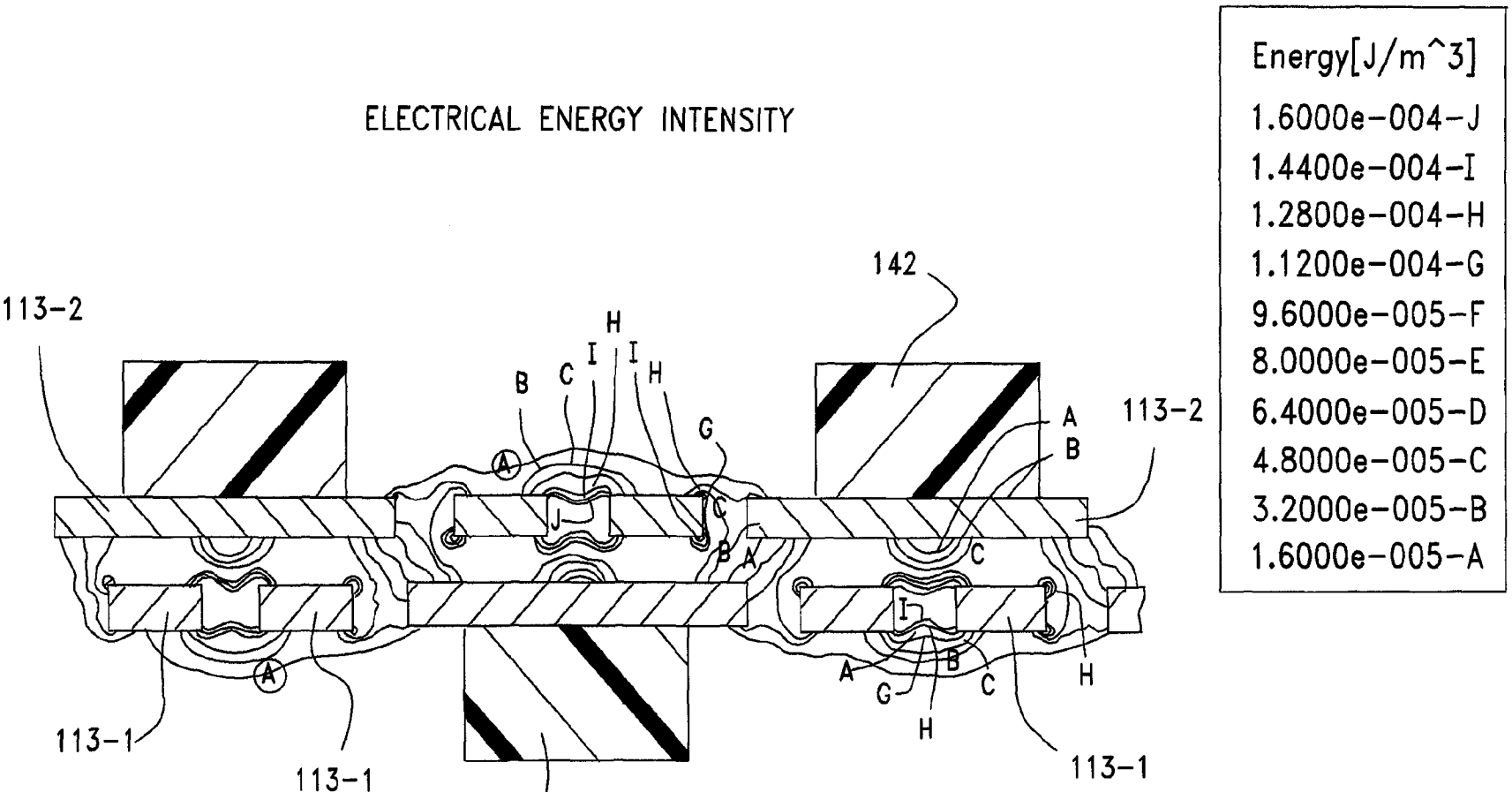
FIG. 10A is an electrical field intensity plot of the terminal body portions of two differential signal channels within the daughter card connector of FIG. 2.
Figure 10B:
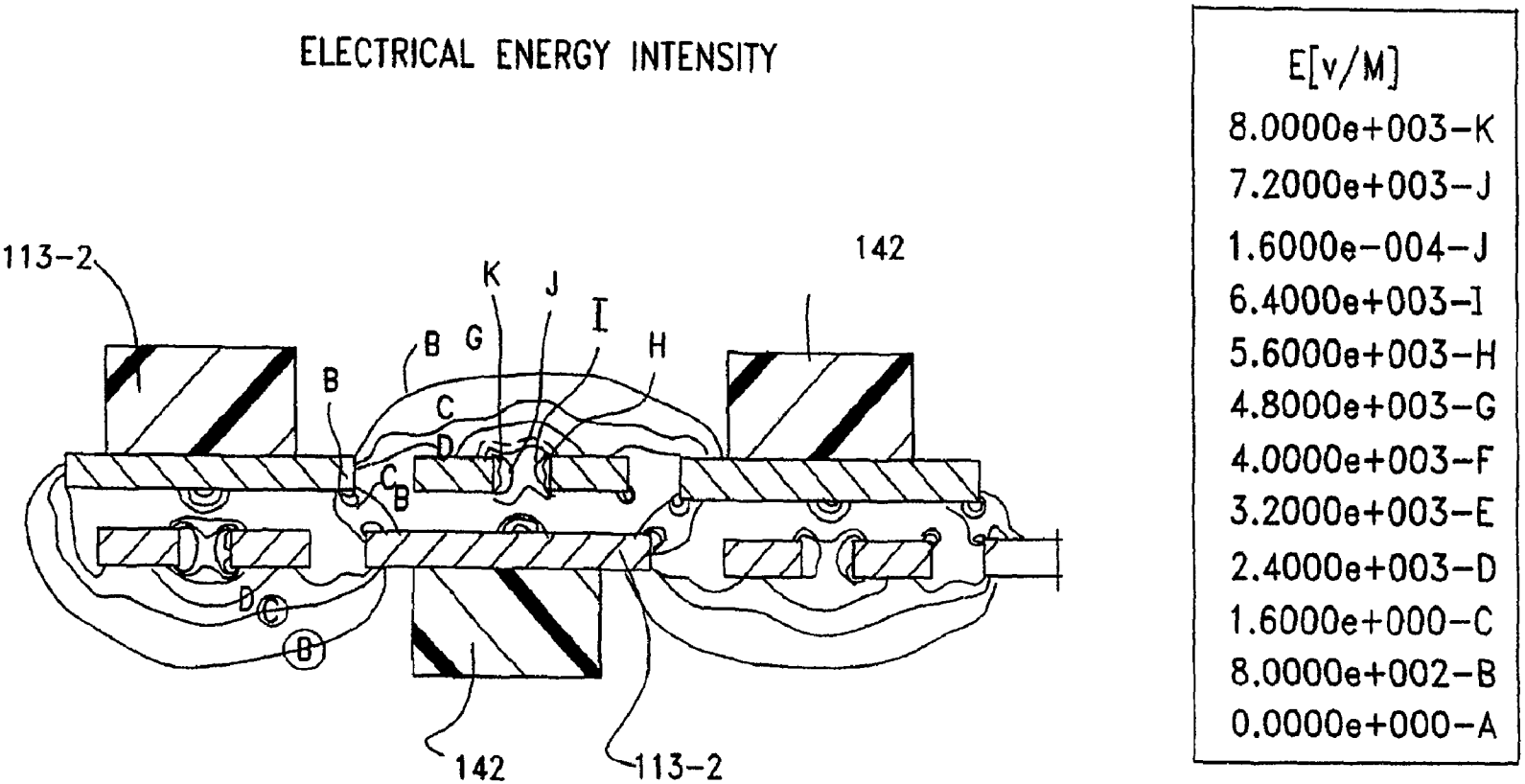
FIG. 10B is an electrical field intensity plot of the body portions of a group of six connector units of the daughter card connector of FIG. 2.

The large ground shield terminal serves to provide a means for constraining the differential signal terminal pair into differential mode coupling, which as depicted is edge coupling in the pair, and helps maintain the edge coupling in that mode while reducing any coupling with any other signal terminals to an absolute minimum. This relationship is best shown in FIGS. 10A and 10B which are respectively, electrical energy intensity and electrical field intensity plots of the terminal body portions. FIG. 10A is an electrical energy intensity plot of the triad-type structure described above. The plots were obtained through modeling a section of the body of the connector unit of the present invention in the arrangement illustrated in FIG. 7B with four differential signal terminal pairs 113-1 and four opposing ground shield terminals 113-2, using ANSOFT HFSS software, in which a differential voltage was assigned to the two signal terminals 113-1 of the pair and the electrical field and energy intensities generated.

These models demonstrate the extent of coupling that will occur in the connectors of the invention. The magnitude of the energy field intensity that occurs between the edges of the two terminals in each differential signal pair, as shown in FIG. 10A, ranges from 1.6 to $1.44\times10^{-4}$ Joule/meter$^3$ while the magnitude of the energy intensity between the two angled edges of the signal terminal pairs between the columns diminishes down to $1.6\times10^{-5}$ and approaches zero, demonstrating the isolation that can be obtained with certain depicted embodiments. Similarly FIG. 10B expresses the electrical field intensity in volts/meter and it shows the field intensity between the edges of the coupled differential signal terminal pair as ranging from $8.00\times10^3$ while the field intensity reduces down to 2.40 to 0.00 volts/meter on the angled path that interconnects the edges of two adjacent differential signal terminal pairs.

Figure 11B:
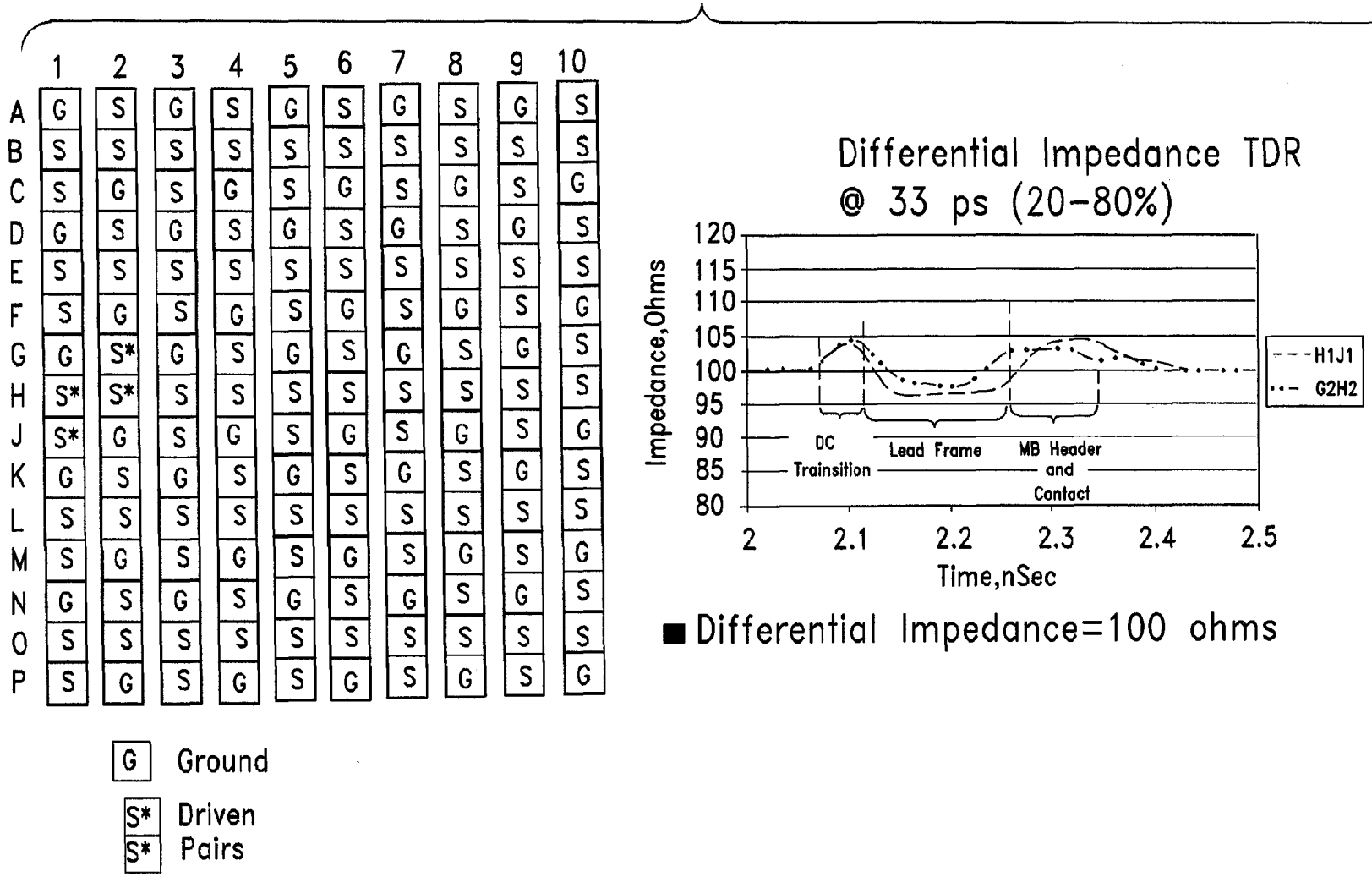
FIG. 11B is a differential impedance plot of a pair of differential signal terminals chosen from the pin map of FIG. 11A identifying the impedance obtained from a simulation of a connector of the present invention.
Figure 11C:
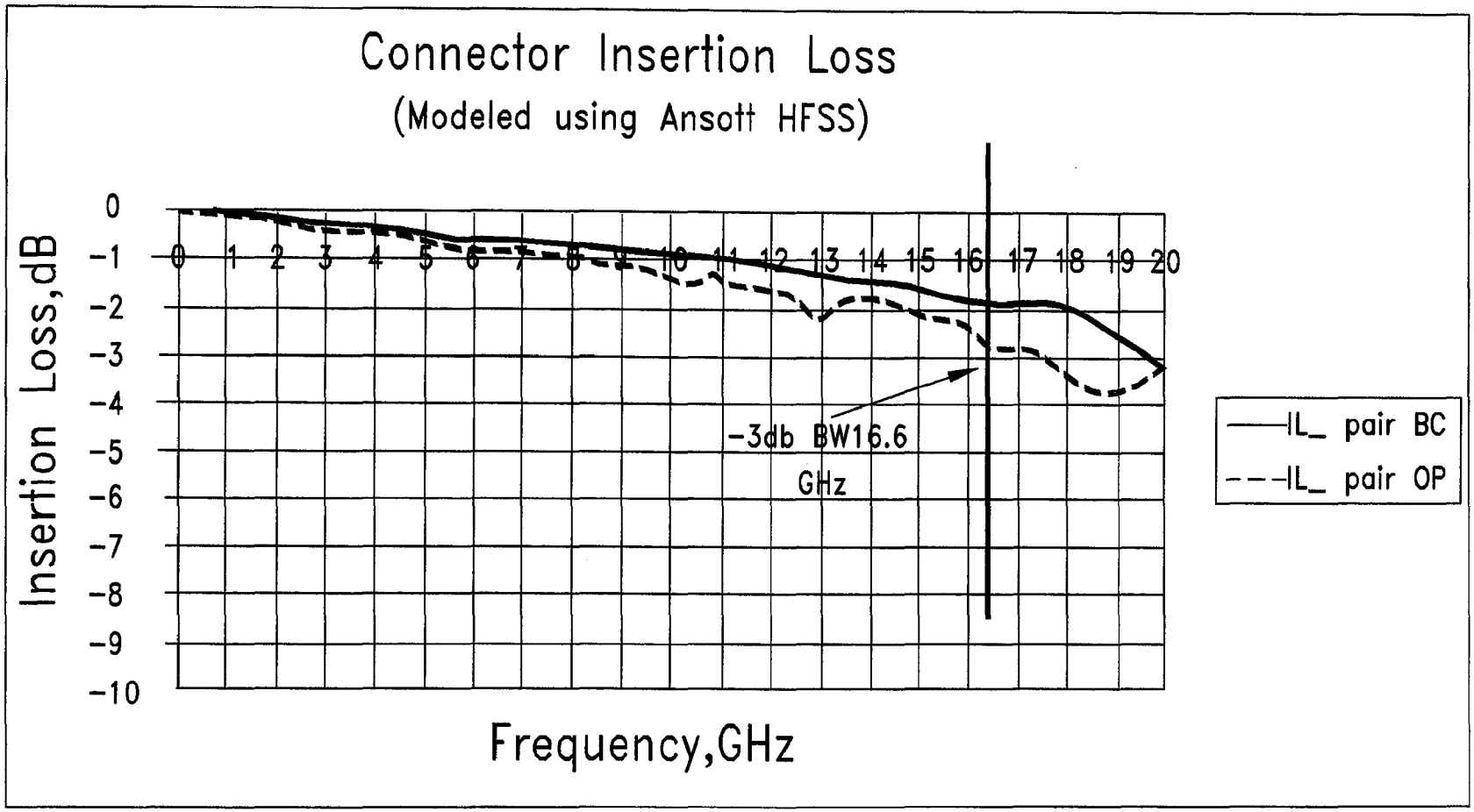
FIG. 11C is a connector insertion loss plot obtained through modeling the connectors of the invention illustrating the minimum and maximum losses incurred and a −3 db loss at a frequency of 16.6 GhZ.
Figure 11D:
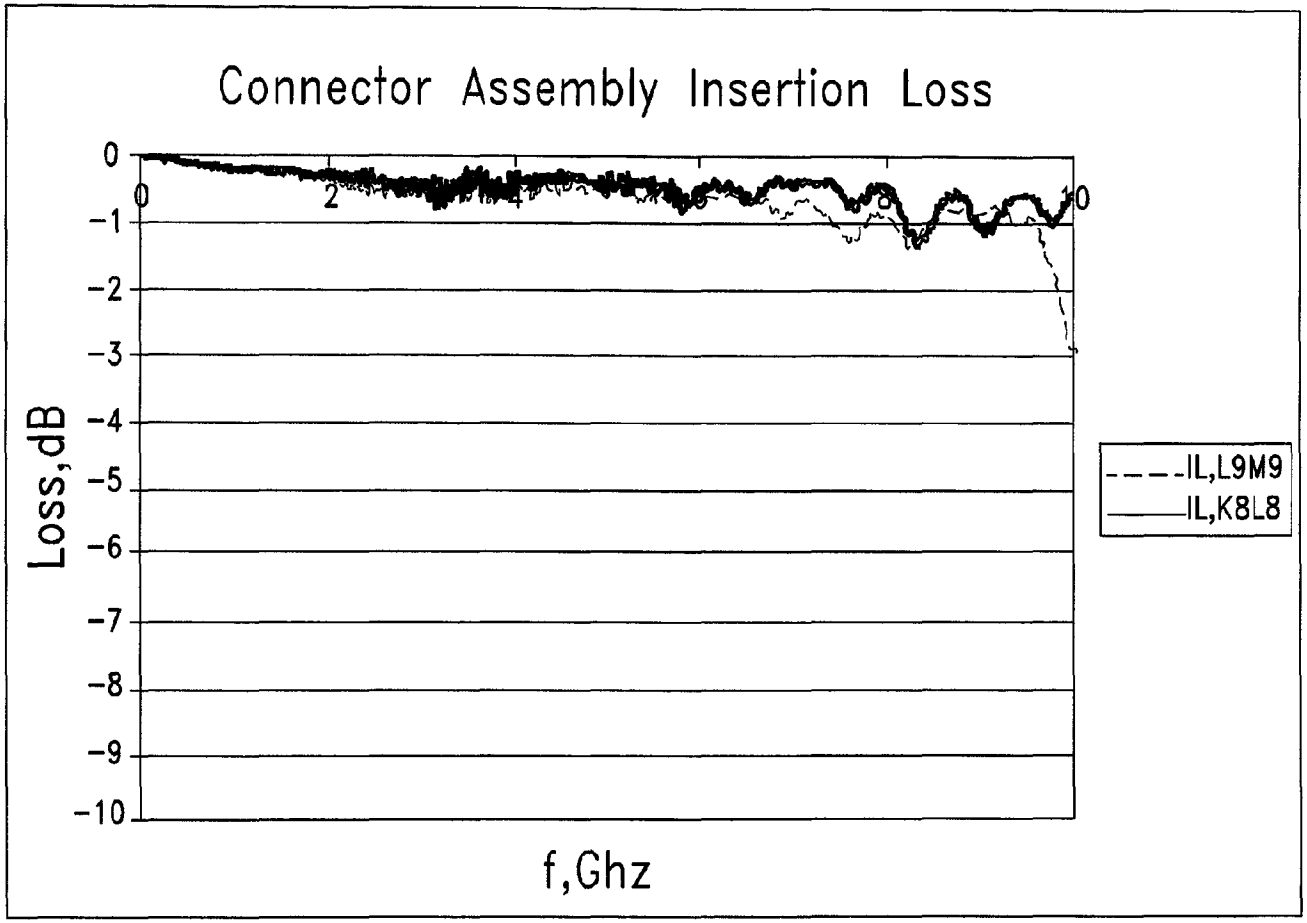
FIG. 11D is a connector assembly insertion loss plot which illustrates the results of actual testing of the connector assembly of FIG. 1 in place on two circuit boards, illustrating an insertion loss of −3 db at a speed of about 10 GHz.

FIGS. 11*c* and 11D illustrate the modeled and measured insertion loss of depicted connectors. FIG. 11C is an insertion loss plot of the connector as shown in FIG. 1, less the two circuit boards and it shows the maximum and minimum loss values obtained using ANSOFT HFSS from the differential signal pairs in rows BC and OP (corresponding to the pin map of FIG. 11A). It indicates that the connector should have a loss of −3 db at a frequency of about 16.6 GHz, which is equivalent to a data transfer rate of 33.2 Gigabits/second. FIG. 11D is an insertion loss plot obtained through testing of an early embodiment of the connector of FIG. 1, including its circuit boards. Again, the maximum and minimum losses are plotted for differential signal pairs at L9M9 and K8L8 and the insertion loss is −3 db at about 10 Ghz frequency, which is capable of supporting a data transfer rate of about 20 Gigabits/second or greater.

Figure 19:
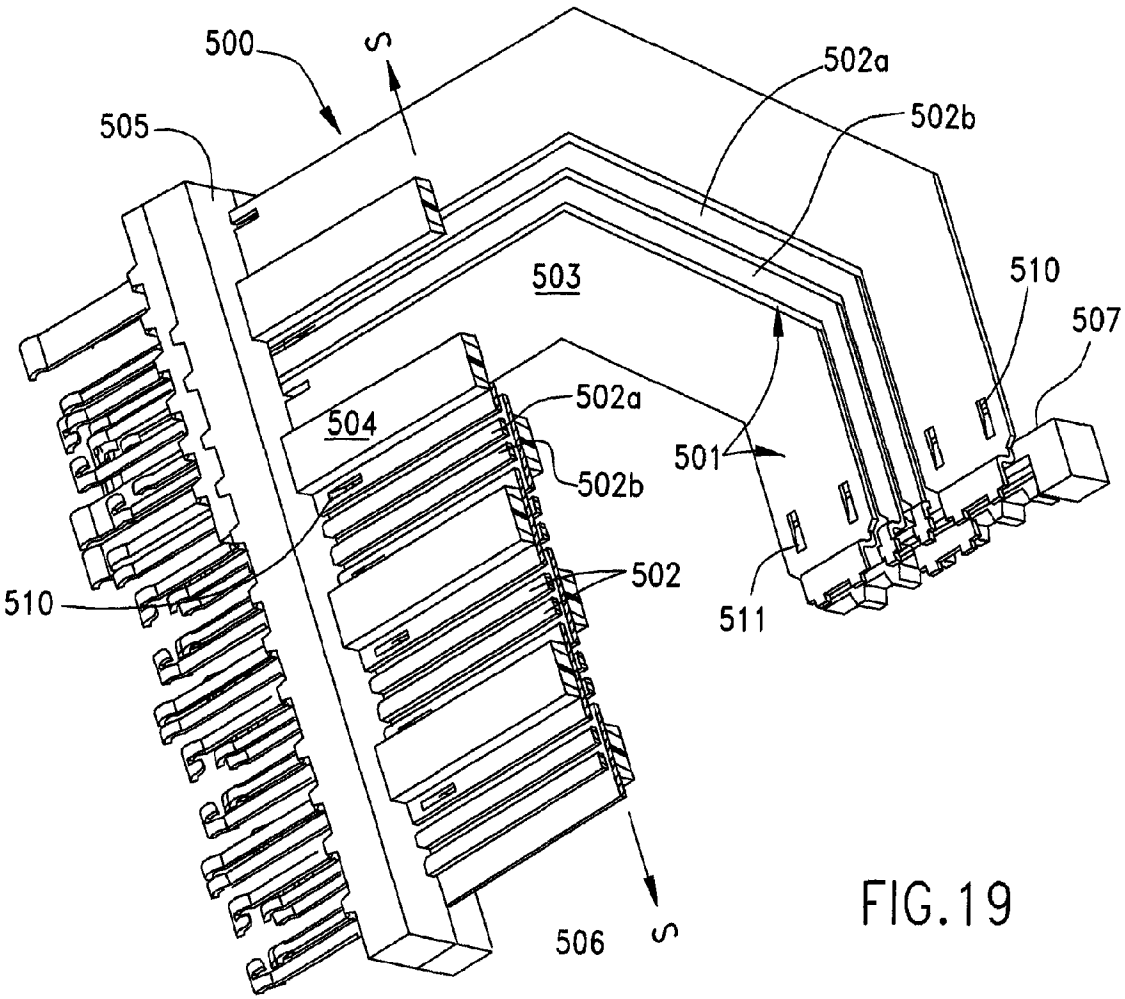
FIG. 19 is a perspective view, partly in section, of another embodiment of a backplane connector element constructed in accordance with the principles of the present invention, in which the ground terminals are larger than the signal terminals and are large enough such that they overlap ground terminals in an adjacent array of terminals.
Figure 20:
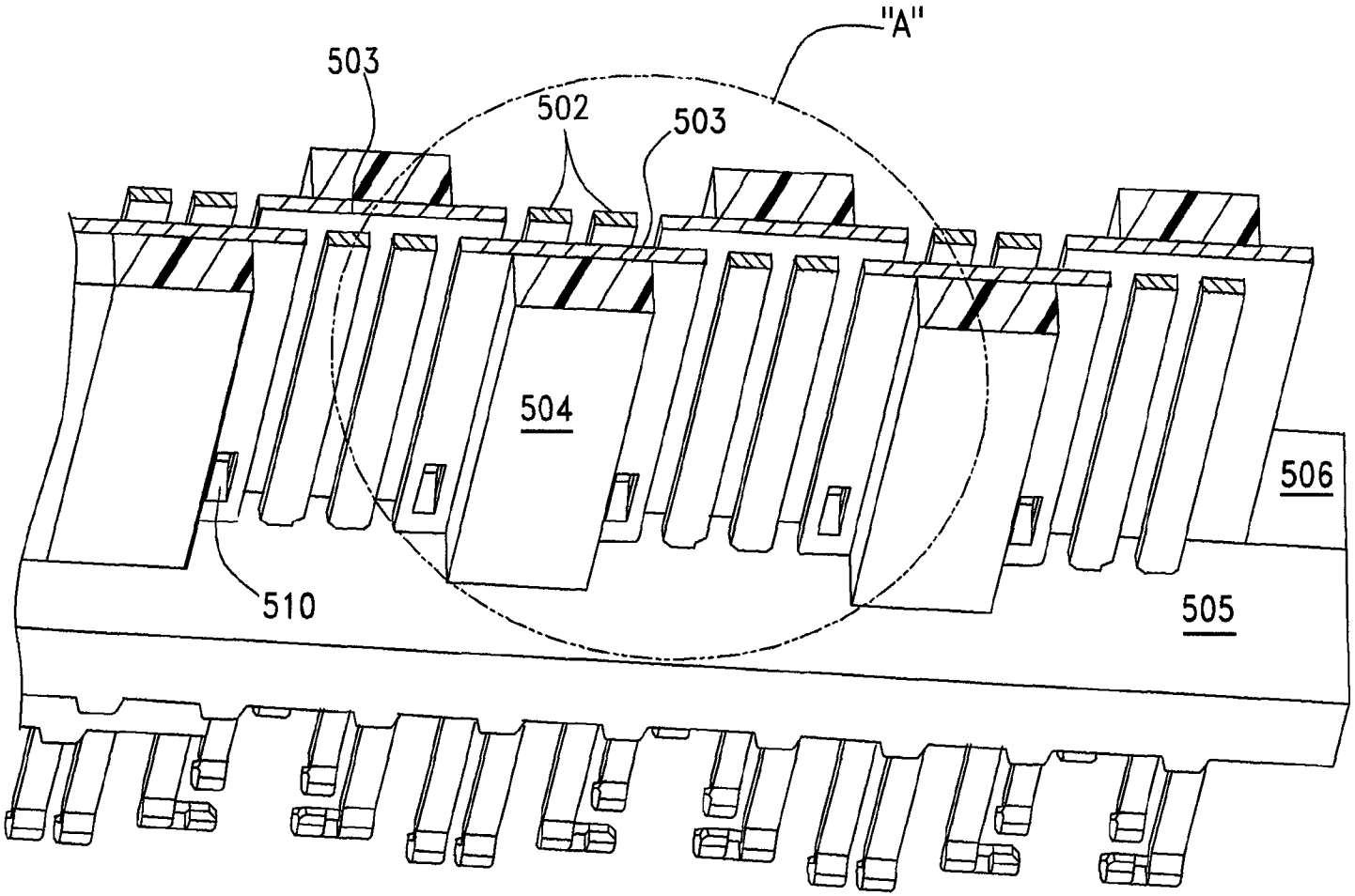
FIG. 20 is an enlarged view of the connector element of FIG. 19 with the section line S-S carried through the entirety of the connector element.

FIG. 19 illustrates another embodiment of an element 500 of a daughter card connector. The connector element 500 is illustrated with a plurality of conductive terminals 501 that are sectioned along line S-S FIG. 20 illustrates best how this connector element 500 differs from the prior described embodiments. Although shown and described in the context of a right-angle connector, the features disclosed herein may be utilized in other applications such as a mezzanine style connector.

The conductive terminals 501 include distinct signal terminals 502 that are arranged in pairs so as to carry differential signals, and wide ground terminals 503 that serve as returns and drains for the connector. The terminals are arranged in linear arrays, or columns in the right-angle application illustrated with the terminals 501 being arranged in each linear array in an edge-to-edge fashion and further in a ground-signal-signal-ground pattern. Each pair of signal terminals 502 are intended to be used as a differential signal transmission line with one terminal 502*a* of the pair of terminals carrying a positive voltage of a given magnitude and the other terminal 502*b* of the pair of terminals carries a negative voltage of the same magnitude.

Figure 21:
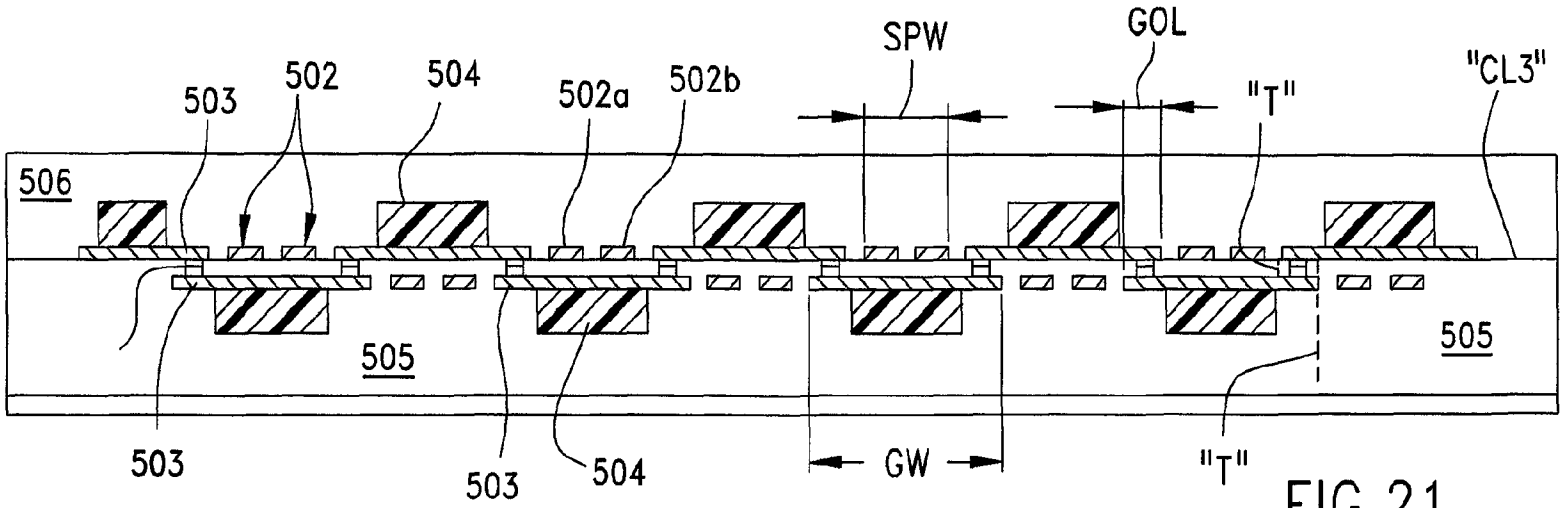
FIG. 21 is an end elevational view of the section line S-S of FIG. 19, but carried through the entire connector element.

As shown, the width (taken edge to edge as shown by GW in FIG. 21) of the ground terminals 503 is substantially larger that the edge to edge width SPW of the differential signal terminal pair 502*a*, 502*b* and the edges or ends of the ground terminals 503 extend past the edges of the ground terminals 503 in an adjacent array of terminals so as to define an area of overlap between the adjacent ground terminals 503, shown toward the left of FIG. 21. In other words, if tangent lines "T" were drawn along the edges of the ground terminals and across the centerline, CVL3 of the connector unit in FIG. 21, they would intersect with the body portions of the ground terminals 503. This overlap is preferably about 10% to about 25% of the width GW of the ground terminals and more preferably about 15% to about 20% of GW. This overlap helps in isolating the differential signal pairs from each other within each column and pair of columns supported by the connector unit by narrowing the aperture which exists between the adjacent signal pairs, widthwise of the connector unit and increasing the distance between the edges of the signal terminal pairs in adjacent terminal arrays. This increased surface area of the grounds relative to the signal terminal pairs increases the capacitance within each differential signal transmission line, or channel, and therefore drives down the impedance of that transmission channel and results also in less noise within the transmission channel and less crosstalk among signal terminal pairs. The larger width of the ground terminals results in a minimizing of the spacing between the signal pairs in which for leakage can occur.

As in the first embodiments, the ground terminals 503 are partially supported along their length by plastic ribs 504 that are formed from the same material as the connector frame halves 505, 506. These ribs have a width that is less than the ground terminals 503 and they provide primarily structural support for the ground terminals 503 but may also be formed of a material with a desired dielectric constant to influence the capacitive coupling of signal terminal pairs to adjacent ground terminals.

Figure 23:
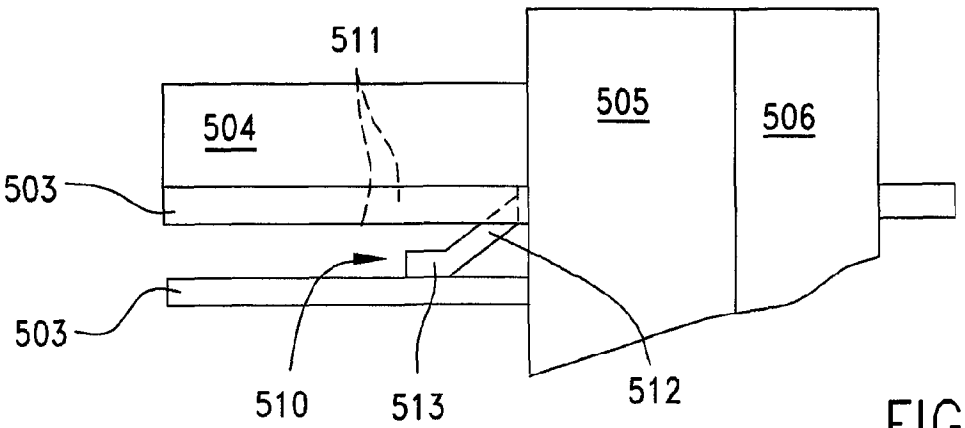
FIG. 23 is a an enlarged, detail view of area "B" of FIG. 22, illustrating the commoning contact that occurs between two adjacent ground terminals of the same connector unit; and, FIG. 24 is a graph of showing a differential impedance plot comparing the crosstalk, as measured by a model using Ansoft modeling software showing the difference between connectors without commoned grounds and connectors with commoned grounds.
Figure 22:
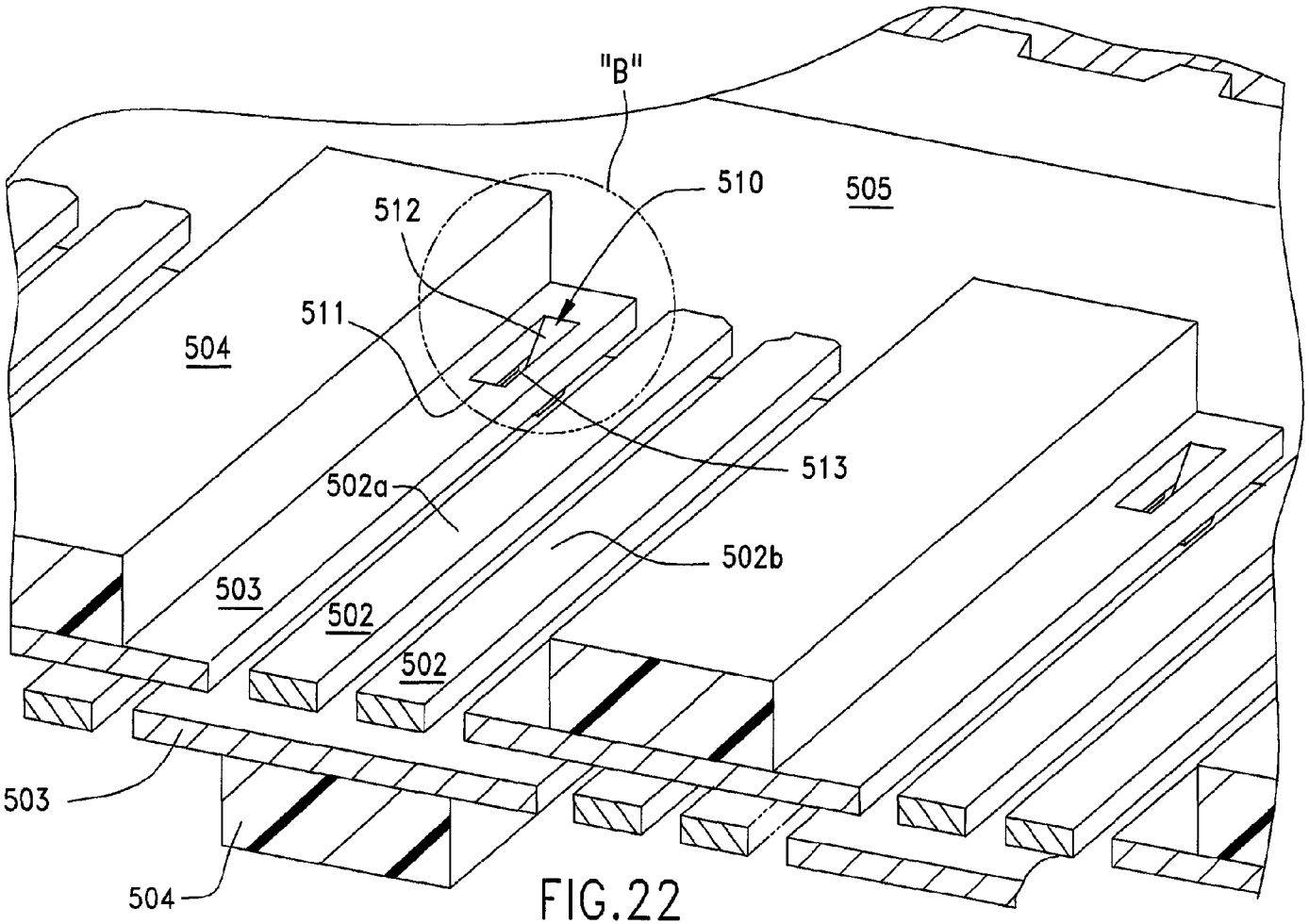
FIG. 22 is an enlarged, detail view of area "A" of FIG. 20.

In an embodiment, the ground terminals 503 of adjacent linear arrays are connected, or shorted, together. This connection is shown occurring in FIGS. 20 & 21 near the front frame member 505 and the rear base member 507, although the contact may occur only near the front frame member, if desired. The means for this contact is shown as contact members that take the form of contact tabs that are stamped and bent out of the body portions of the ground terminals 503 in the areas thereof that overlap adjacent ground terminals. FIG. 23 shows the manner in which the tabs 510 are formed, with a spring arm, or body portion, 512 that terminates in a free end 513, preferably having a flat contact face disposed thereon. The tabs 510 are stamped from a window 511 that is formed in the corresponding ground terminal 503. Although a flat, abutting contact is illustrated, other forms of contact such as point or angle contact may also be used.

Figure 24:
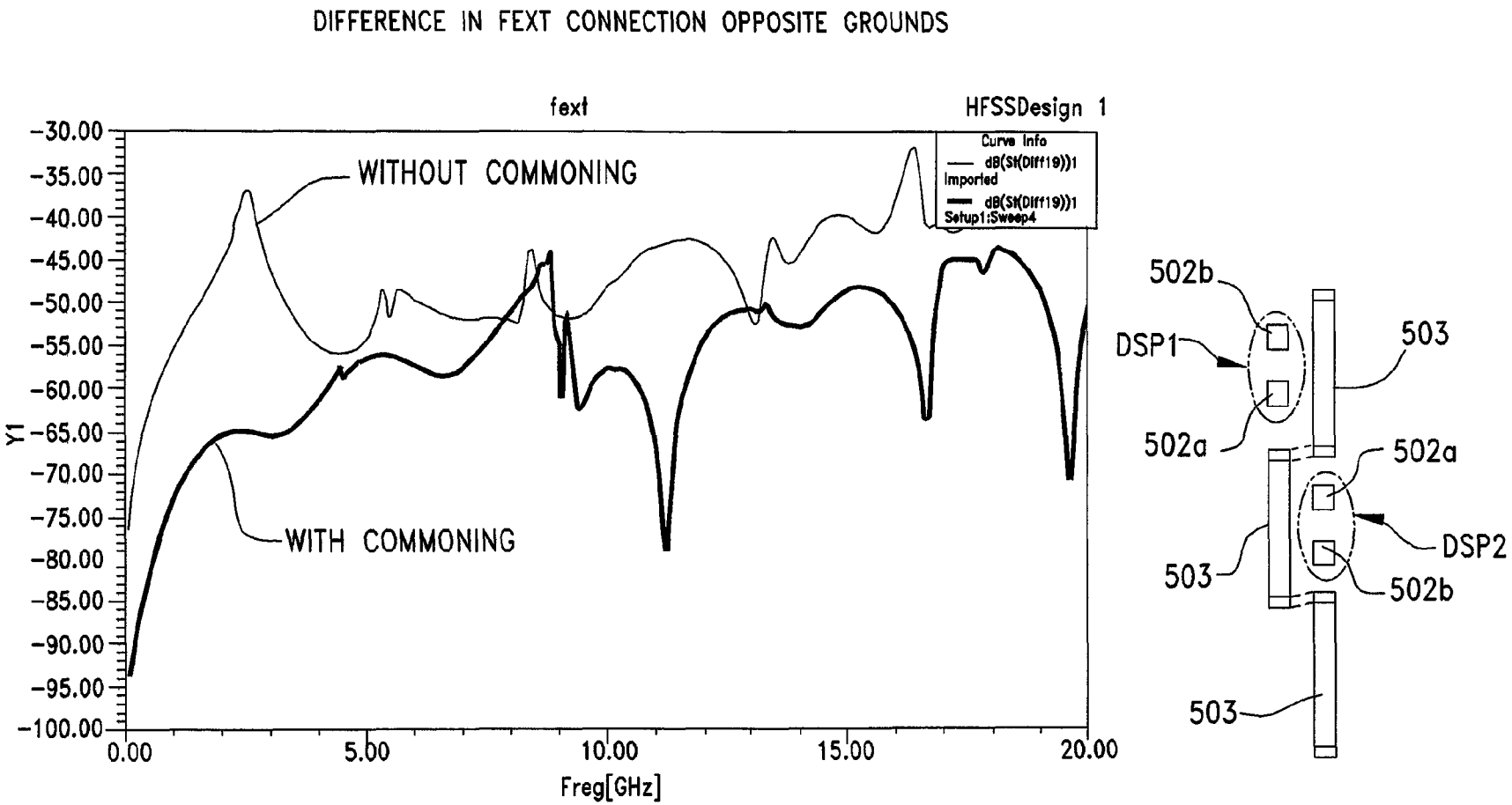

This commoning provides multiple paths for the current induced in the ground terminals (and its resultant electrical field) to drain, thereby helping to lower the amount of resonance that may occur during operation. FIG. 24 is a graph showing the far end crosstalk which should occur between adjacent differential signal pairs complied by Ansoft HFSS software. This crosstalk is measured between terminals 502*b* in the two pairs, DSP1 and DSP 2 shown in the diagram beside the graph. Some of the peaks on the graph show a reduction of about 25-29 dB.

Figure 12:
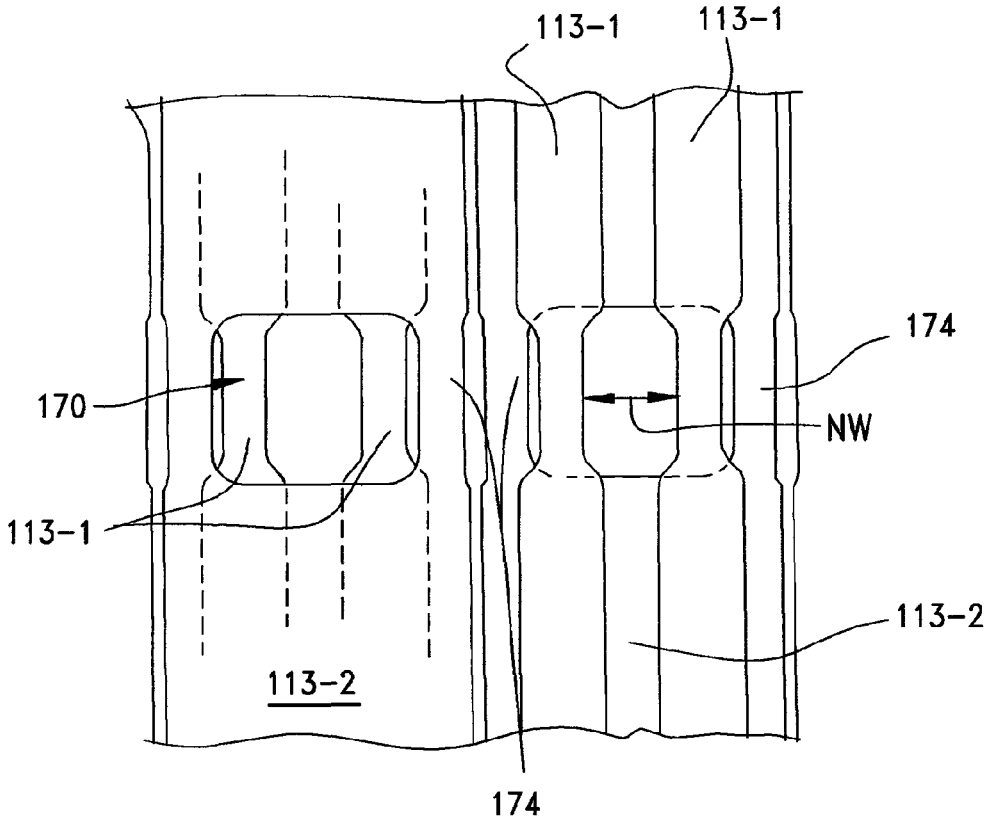
FIG. 12 is an enlarged detail view of the area where the terminal array of the connector crosses a support frame spoke of the connector unit.

FIG. 11A is a crosstalk pin map representing the pin layout of a connector constructed in accordance with the principles of the present invention and as shown in FIG. 1. In order to identify the relevant terminals of the connector, the rows of terminal have an alphabetical designation extending along the left edge of the map, while the columns are designated numerically along the top edge of the map. In this manner, any pin may be identified by a given letter and number. For example, "D5", refers to the terminal that is in the "D" row of the"5" column. A victim differential signal pair was tested by running signals through four adjacent differential signal pairs that are designated in FIG. 12 as "aggressor" pairs. Two of the six surrounding adjacent pairs are identical or mirror images of their counterparts so that only four of the six aggressor pairs were tested, as is common in the art. The testing was done with a mated daughter card and backplane connector mounted in place on circuit boards, at a rise time of 33 picoseconds (20-80%) which is equivalent to a data transfer rate of approximately 10 gigabits per second through the terminals. As can be seen in the table below, the cumulative near end crosstalk (NEXT) on the victim pair was 2.87% and the far end crosstalk (FEXT) was 1.59%, both values being below 3%, and FIG. 11B is a plot of the differential impedance (TDR) modeled through the connector using signals at a 33 picosecond (ps) rise time (20-80%) taken along the differential signal terminal pairs, H1-J1 and G2-H2 of FIG. 11A.

The impedance achieved is approximately +/−10% of the desired baseline 100 ohm impedance through the connector assembly and circuit boards at a 33 picosecond rise time. The various segments of the connector assembly are designated on the plot. The impedance rises only about 5 ohms (to about 103-104 ohms) in the transition area of the daughter card connector 106 where the terminal tail portions expand to define the terminal body portions, and the impedance of the pair terminal body portions, where the large ground shield terminals 113-2 are associated with their differential signal terminal pairs drops about 6-8 ohms (to about 96-97 ohms) and remains substantially constant through the connector unit support frame. As the daughter card connector terminal contact portions 113*b* make contact with the terminals 111 of the backplane connector 108, the impedance rises about 6-8 ohms (to about 103-104 ohms), and then the impedance through the backplane connector (pin header) 108 reduces down toward the baseline 100 ohm impedance value. Thus, it will be appreciated that connectors of the invention will have low cross-talk while maintaining impedance in an acceptable range of +/−10%.

Returning to FIG. 4, each wafer half has an insulative support frame 130 that supports its column of conductive terminals. The frame 130 has a base part 131 with one or more standoffs 132, in the form of posts or lugs, which make contact with the surface of the daughter card where the daughter card connector is mounted thereto. It also has a vertical front part 133. These parts may be best described herein as "spokes" and the front spoke 133 and the base spoke 131 mate with each other to define two adjacent and offset surfaces of the connector unit and also substantially define the boundaries of the body portions 113*c* of the terminals 113. That is to say the body portions 113*c* of the terminals 113, the area where the ground shield terminals 113-2 are wider and larger than their associated differential signal terminal pair extend between the base and front spokes 131, 133.

The bottom spoke 131 and the front spoke 133 are joined together at their ends at a point "O" which is located at the forward bottom edge of the connector units 112. From this junction, a radial spoke 137 extends away and upwardly as shown in a manner to bisect the area between the base and vertical spoke 135 into two parts, which, if desired, may be two equal parts or two unequal parts. This radial spoke 137 extends to a location past the outermost terminals in the connector unit 112. Additional spokes are shown at 138, 139 & 140. Two of these spokes, 138 and 139 are partly radial in their extent because they terminate at locations before the junction point "O" and then extend in a different direction to join to either the vertical front spoke 135 or the base spoke 131. If their longitudinal centerlines would extend, it could be seen that these two radial spokes emanate from the junction point "O". Each terminus of these two part-radial spokes 138, 140 occurs at the intersection with a ground shield rib 142, the structure and purpose of which is explained to follow. The radial spokes are also preferably arranged in a manner, as shown in FIG. 4, to evenly transfer the load imposed on the connector units to the top parts of the compliant pin terminal tail portions when the connector units are pressed into place upon the daughter card 102.

The ribs 142 of the support frame provide the ground shield terminals with support but also serve as runners in the mold to convey injected plastic or any other material from which the connector unit support frames are formed. These ribs 142 are obviously open areas in the support frame mold and serve to feed injected melt to the spokes and to the points of attachment of the terminals to the support frame. The ribs 142 preferably have a width RW as best shown in FIG. 8B, that is less than the ground shield terminal width GW. It is desired to have the width of the rib 142 less than that of the ground shield terminals 113-2 so as to effect coupling between the edge of a differential signal terminal pair facing the edge of the ground shield terminal 113-2 and its rib 142 so as to limit the concentration of an electrical field at the ground terminal edges, although it has been found that the edges of the rib 142 can be made coincident with the edges of the ground shield terminals 113-2. However, keeping the edges of the ribs 142 back form the edges of the ground shield terminals 113-2 facilitates molding of the connector units for it eliminates the possibility of mold flash forming along the edges of the ground shield terminal and affecting the electrical performance thereof. The ground shield terminal also provides a datum surface against which mold tooling can abut during the molding of the support frames. As shown in FIG. 8A and as utilized in one commercial embodiment of the present invention, the backing ribs 142 have a width that ranges from about 60 to about 75% of the width of the ground shield terminal 113-2, and preferably have a width of about 65% that of the ground shield terminal.

Figure 4:
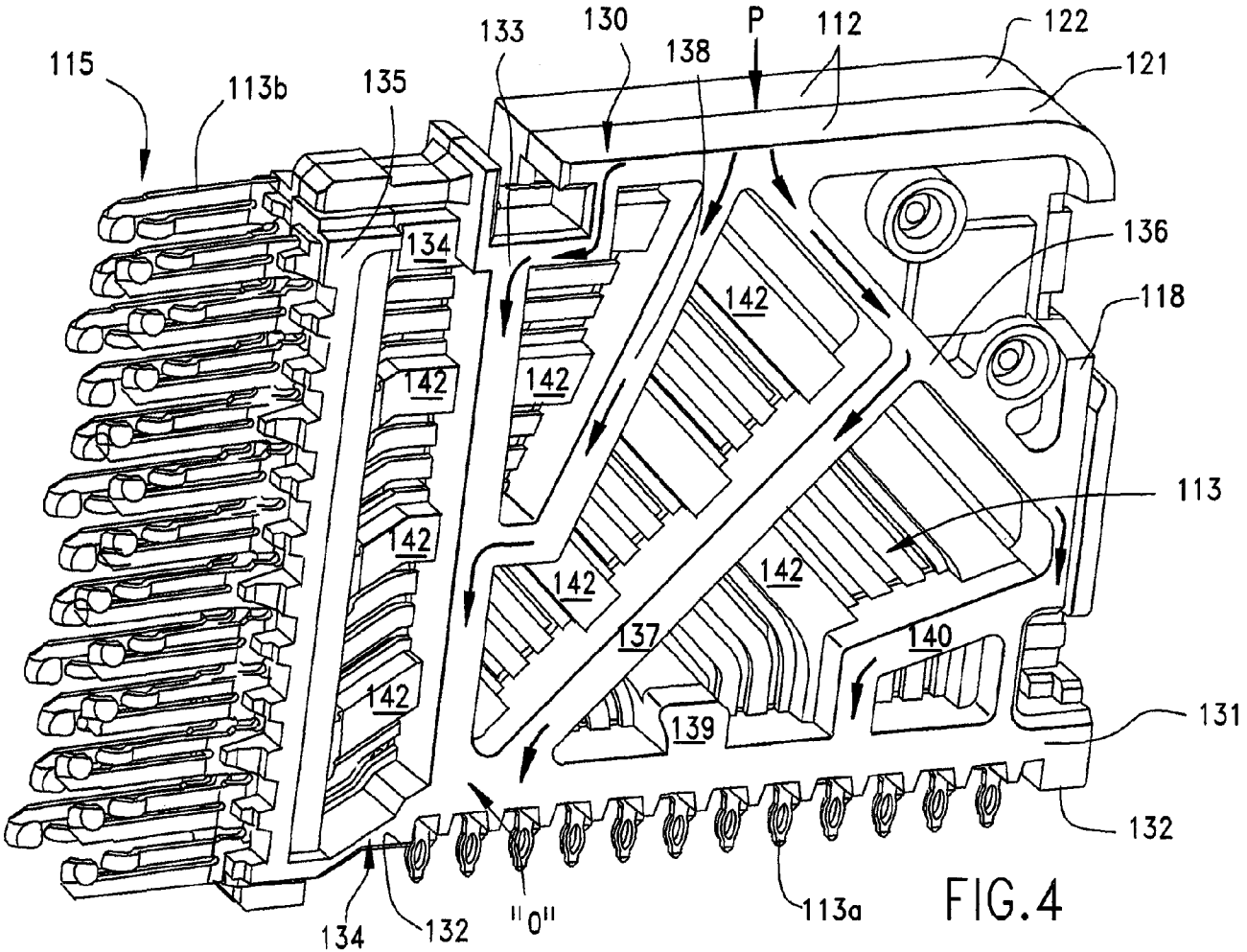
FIG. 4 is a slight perspective view of one connector unit that is used in the connector of FIG. 3, and shown in the form of a wafer assembly.
Figure 6:
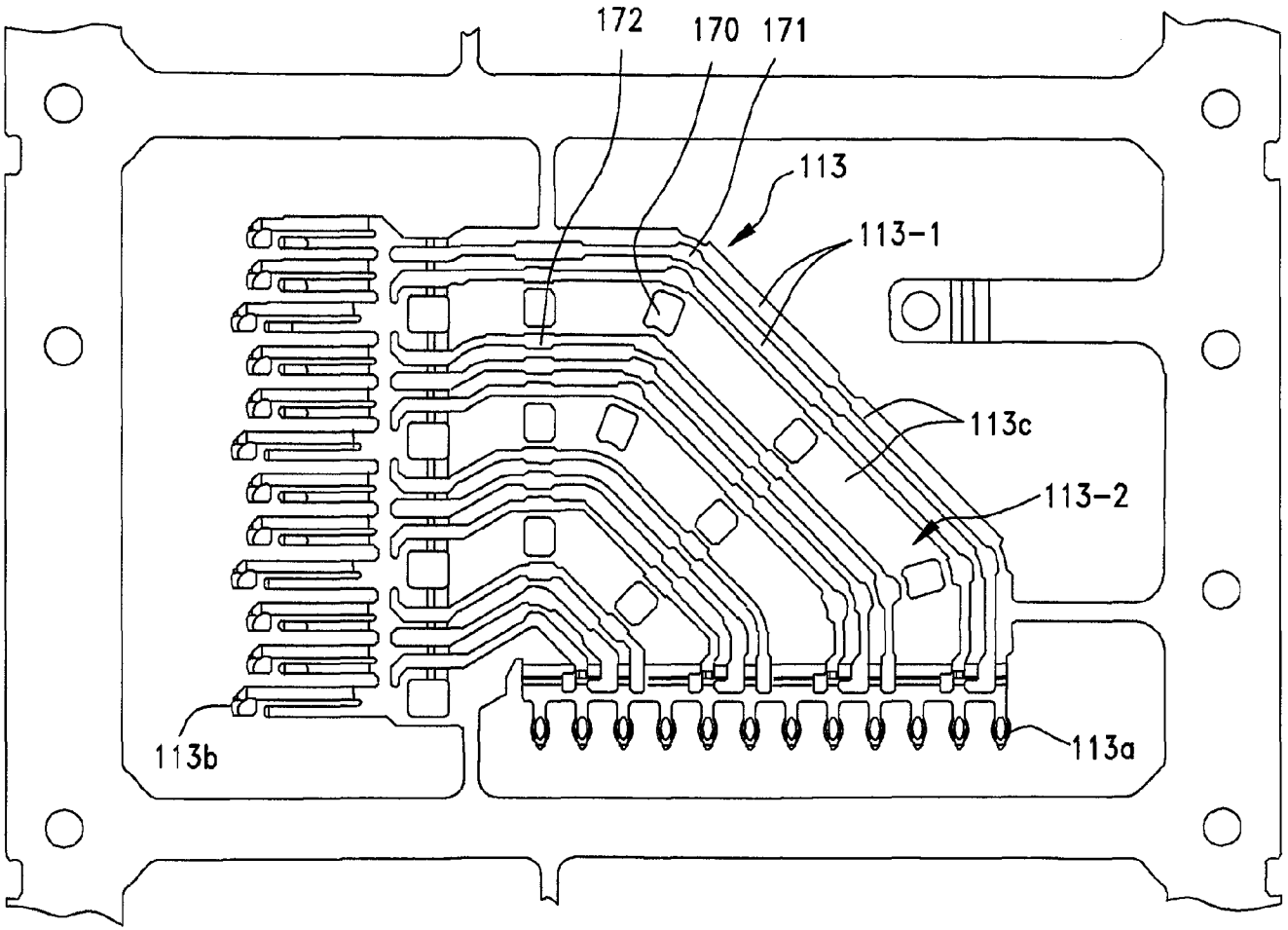
FIG. 6 is a plan view of the terminal assembly used in each half of the connector unit of FIG. 4, shown held in a metal leadframe and prior to singulation and overmolding thereof.
Figure 9:
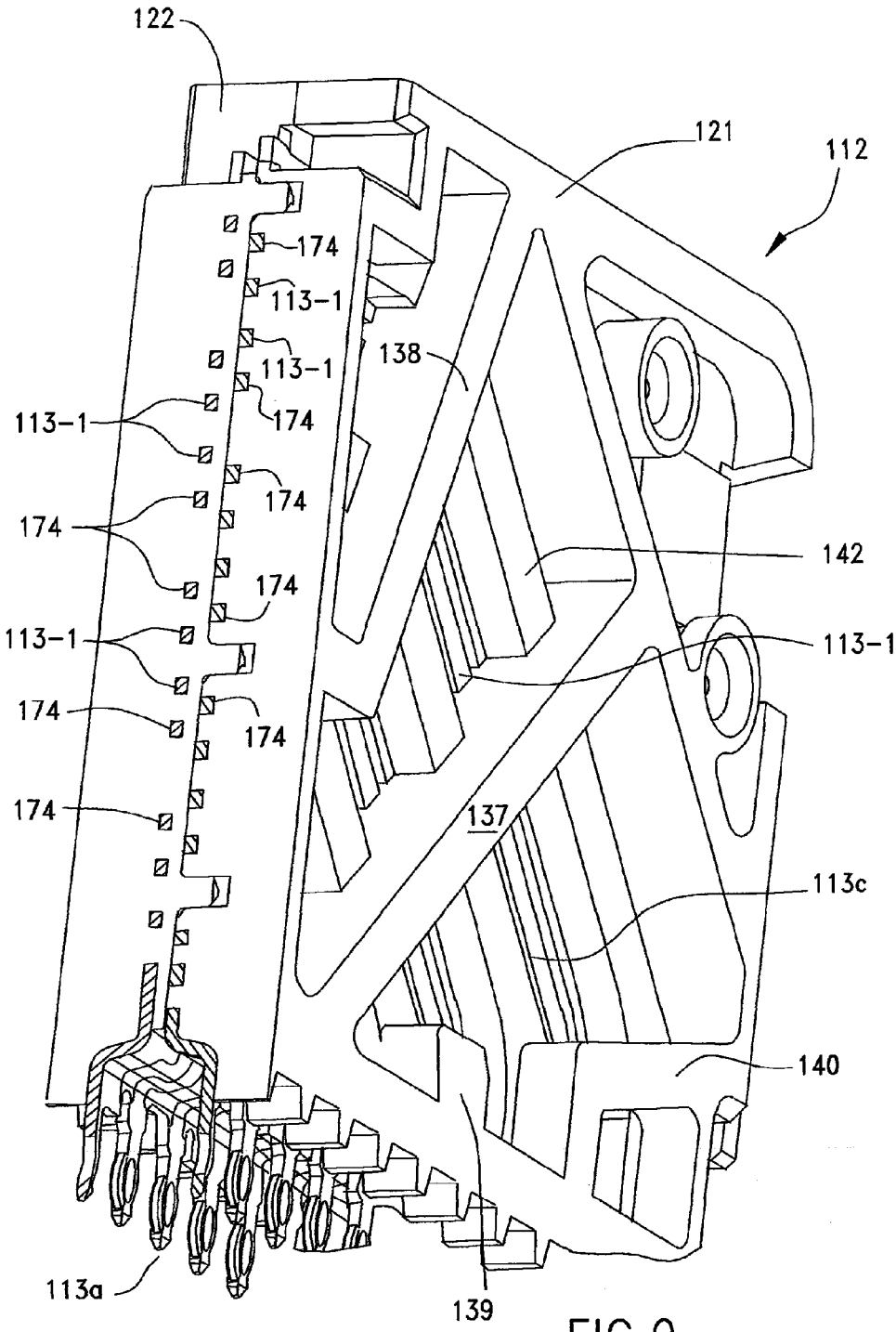
FIG. 9 is a sectional view of the daughter card connector of FIG. 2, taken along lines 9-9 thereof which is a vertical line aligned with the front vertical spoke, illustrating the arrangement of the terminals as they pass though a support frame spoke of the connector unit frame.

FIG. 4 further shows an additional vertical spoke 135 that is spaced apart forwardly of the front spoke 133 and is joined to the connector unit 122 by way of extension portions 134. This additional vertical spoke encompasses the terminals at the areas where they transition from the terminal body portions to the terminal contact portion 113*b*. In this transition, the large ground shield terminals are reduced down in size to define the bifurcated format of the terminal contact portions 113*b* as shown best in FIGS. 6 and 9.

Figure 5A:
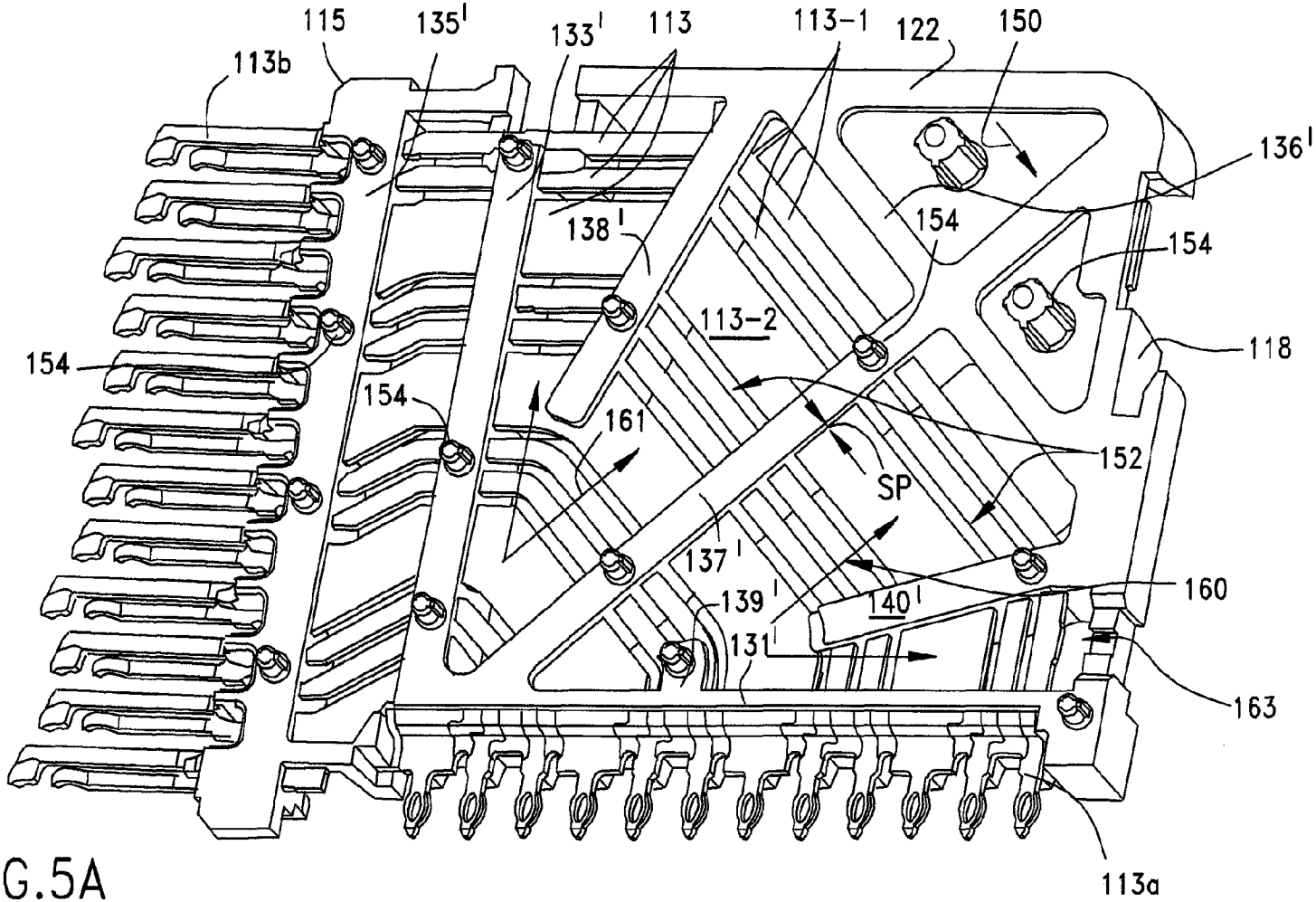
FIG. 5A is an interior view of the right hand wafer half of the connector unit of FIG. 4.

As shown in FIG. 5A, the radial spokes 133, 135, 137, 138, 139 and 140 may be considered as partially continuing on the interior surface 150 of one of the connector unit wafer halves 122. These elements serve as stand-offs to separate the columns of two terminals 113 apart from each other when the two connector unit wafer halves 121, 122 are married together to form a connector unit 112. The interior surface 150 in FIG. 5A illustrates 6 such spoke elements. One is base interior spoke 131' that intersects with front vertical interior spoke 133 at the junction "O". Another interior spoke 137' extends as a bisecting element in a diagonal path generally between two opposing corners of the connector unit wafer half 122. Two other radial, interior spokes 138', 140' extend between the bisecting interior spoke 137' and the base and front interior spokes 131' and 133'. In the preferred embodiment illustrated, the other radial interior spokes 138', 140' are positioned between the radial interior spoke 137' and the base and front interior spokes 131' and 133' so as to define two V-shaped areas in which air is free to circulate. The connector unit wafer half 122 is preferably provided with a means for engaging the other half and is shown in the preferred embodiment as a plurality of posts 154. The posts 154 are formed in the area where the differential signal terminals are narrowed, and oppose the ground shield terminal windows 170. Each spoke member contains a corresponding recess 155 that receives the posts 154. The inner spokes also serve to provide the desired separation SP between the columns of terminals 113 in the connector unit 112. In this regard, the inner spokes also serve to define two V-shaped air channels that are indicated by the arrows 160, 161 in FIG. 5A. Both of these V-shaped air channels are open to the exterior of the connector unit through the slots 163 that bound the topmost terminals in either of the connector unit wafer halves.

Figure 5B:
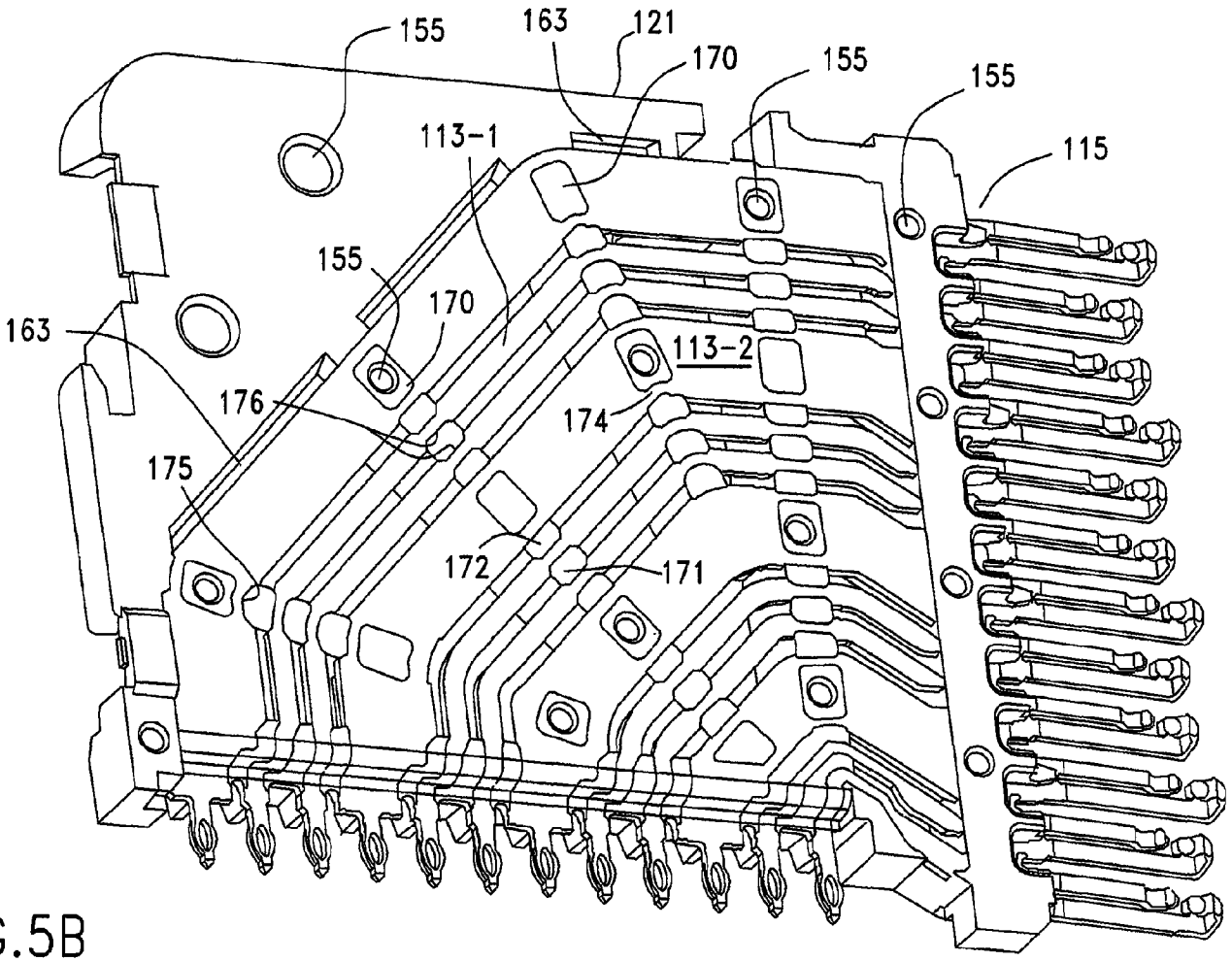
FIG. 5B is an interior view of the left hand wafer half of the connector unit of FIG. 4.

The opposing connector unit wafer half 121 as shown in FIG. 5B, includes a plurality of recesses, or openings, 155 that are designed to receive the posts 154 of the other wafer half 122 and hold the two connector unit wafer halves 121, 122 together as a single connector unit 112. In the areas where the two connector halves 121, 122 are joined together the impedance of the connector units 112 is controlled by reducing the amount of metal present in the signal and ground terminals 113-1, 113-2. This reduction is accomplished in the ground shield terminals 113-2 by forming a large, preferably rectangular window 170 in the terminal body portion 113*c* that accommodates both the posts 154 and the plastic of the connector unit support frame halve. Preferably, these windows have an aspect ratio of 1.2, where one side is 1.2 times larger than the other side (1.0). This reduction is accomplished in the signal terminals by "necking" the signal terminal body portions 113*c* down so that two types of expanses, or openings 171, 172 occur between the differential signal terminal pair and the terminals 113-1 of that pair and the ground shield terminal 113-2, respectively. The narrowing of the terminal body portions in this area increases the edge to edge distance between the differential signal terminal pair, which there by affects its coupling, as explained below.

Figure 13:
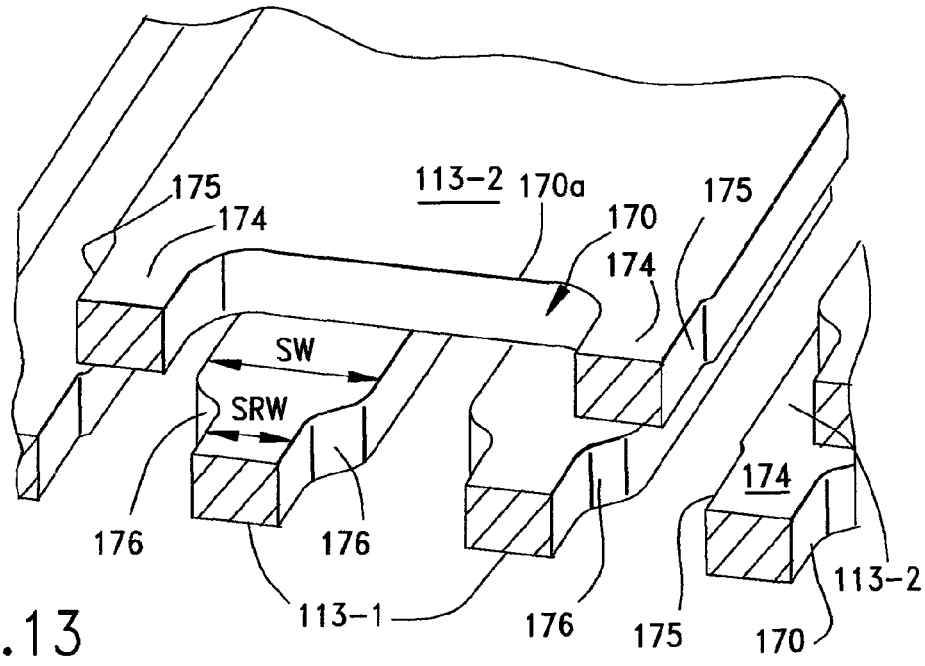
FIG. 13 is a sectioned view of the area of FIG. 12, illustrating the relative positions of the signal pair and ground shield terminals in the area where they are joined to the support frame of the two wafer halves.
Figure 14:
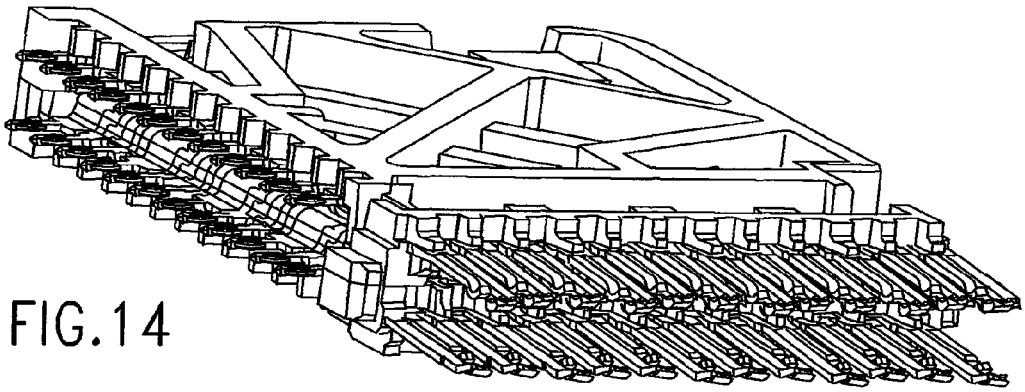
FIG. 14 is perspective view of a connector unit of the present invention used in the connector of FIG. 2, and turned upside down for clarity purposes in order to illustrate the ends of the body portions of the terminals and the tail portions that extend therefrom

The window 170 is formed within the edges of the ground shield terminal 113-2 and the terminal extent is continued through the window area by two sidebars 174, which are also necked down as seen best in FIG. 13. Preferably, the window 170 exhibits an aspect ratio (height/width) of 1.2. The necking between the ground shield terminals 113-2 and the adjacent differential signal terminal 113-1 is defined by two opposing recesses that are formed in the edges of the signal and ground shield terminals 113-1, 113-2. As shown in the section view of FIG. 13, recesses 175 are formed in the opposing edges of the ground shield terminal 113-2 in the area of the window 170 and may slightly extend past the side edges 170*a* of the windows 170. Other recesses 176 are formed in the edges of the signal terminals 113-1 so that the width of the signal terminals 113-1 reduces down from their normal body portion widths, SW to a reduced width at the windows, RSW. The width of the necked opening NW (FIG. 12) between the two terminals of the differential signal pair is preferably equal to or greater than the signal terminal width SW and preferably the necked width is no more than about 10% greater than the signal terminal width.

This structural change is effected so as to minimize any impedance discontinuity that may occur because of the sudden change in dielectric, (from air to plastic). The signal terminals 113-1 are narrowed while a rectangular window 170 is cut through the ground shield terminals 113-2. These changes increase the edge coupling physical distance and reduce the broadside coupling influence in order to compensate for the change in dielectric from air to plastic. In the area of the window, a portion of the metal of the large ground shield terminal is being replaced by the plastic dielectric in the window area and in this area, the widths of the signal terminals 113-1 are reduced to move their edges farther apart so as to discourage broadside coupling to the ground shield terminal and drive edge coupling between the differential signal terminals 113-1. This increase in edge spacing of the signal terminals 113-1 along the path of the open window 170 leads the differential signal terminal pair to perform electrically as if they are spaced the same distance apart as in their regular width portions. The spacing between the two narrowed signal terminals is filed with plastic which has a high dielectric constant than does air. The plastic filler would tend to increase the coupling between the signal terminal pair at the regular signal terminal pair edge spacing, but by moving them farther apart in this area, electrically, the signal terminal pair will operate as if they are the same distance apart as in the regular area, thereby maintaining coupling between them at the same level and minimizing any impedance discontinuity at the mounting areas.

Figure 15:
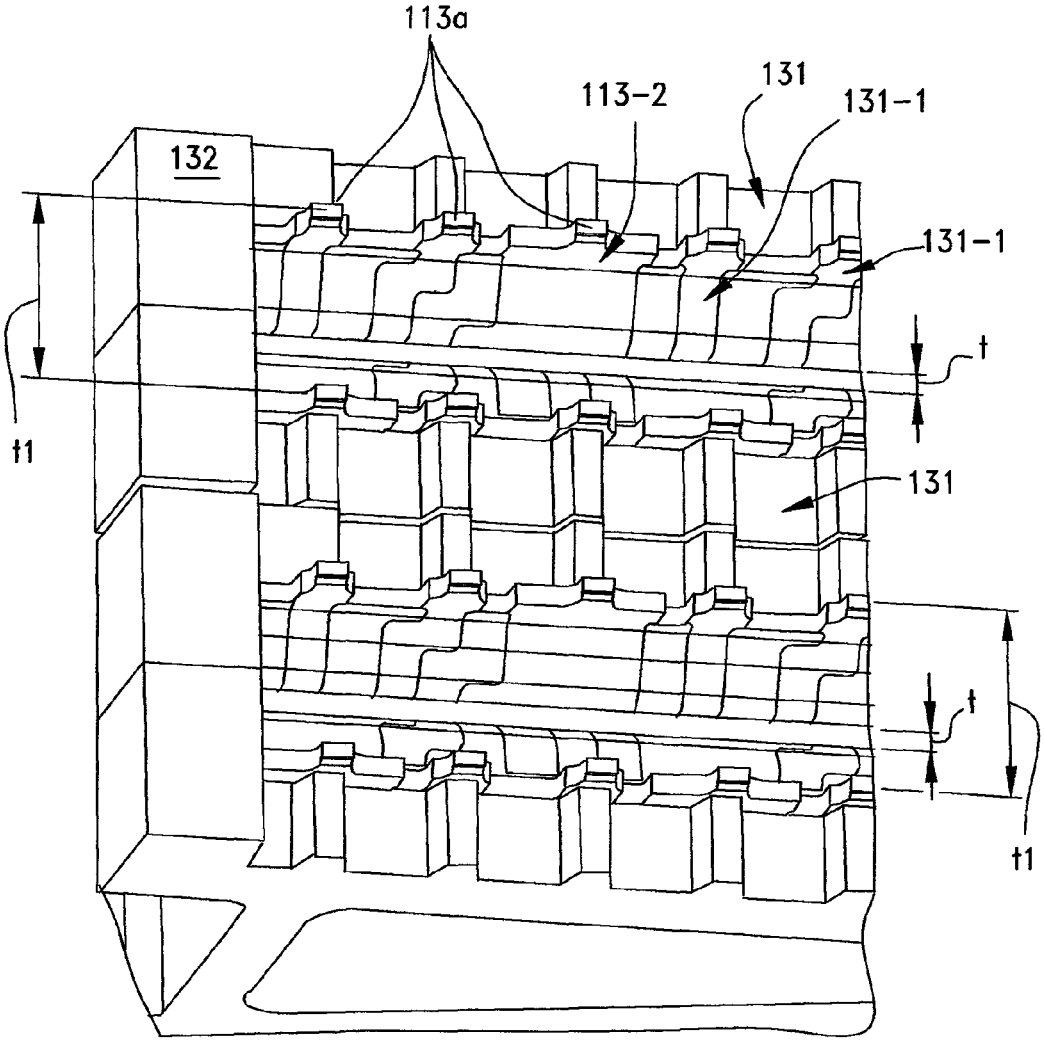
FIG. 15 is an enlarged detail view of the bottom of two connector units of the present invention illustrating the tail portions as they extend away from the terminal body portion ends.
Figure 16:
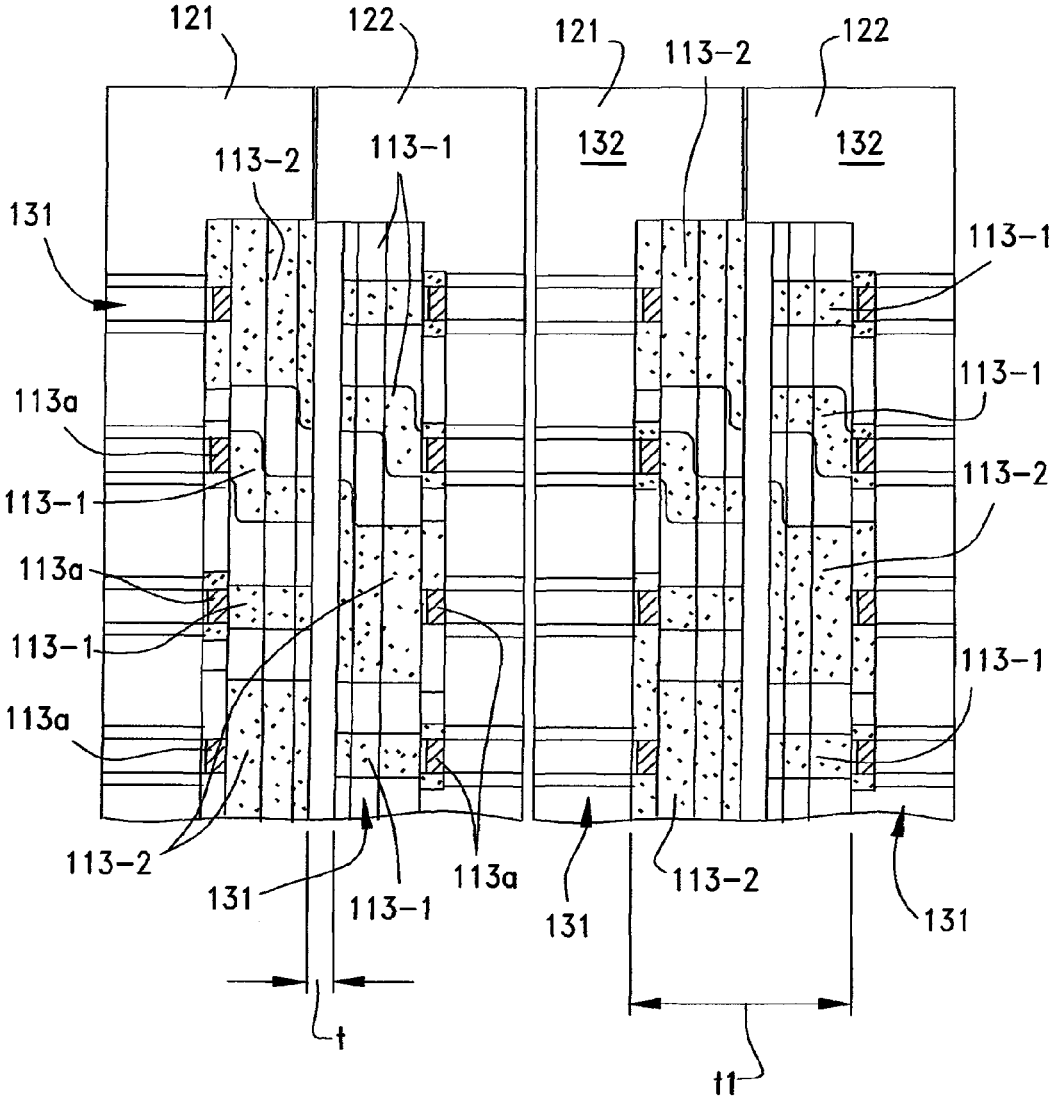
FIG. 16 is a bottom plan view of FIG. 15.
Figure 17:
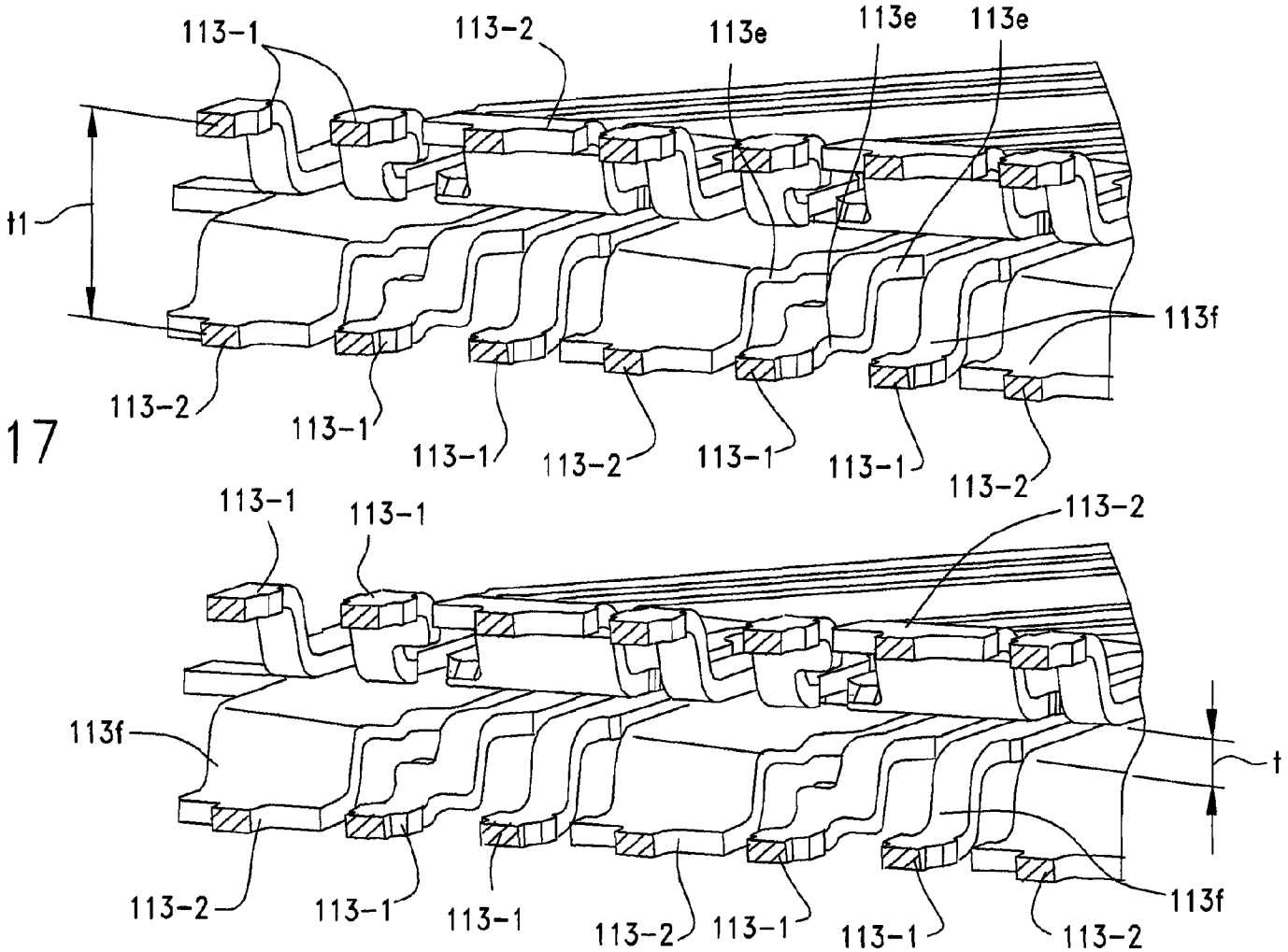
FIG. 17 is the same view as FIG. 15 but with the connector unit support frame removed for clarity.
Figure 18:
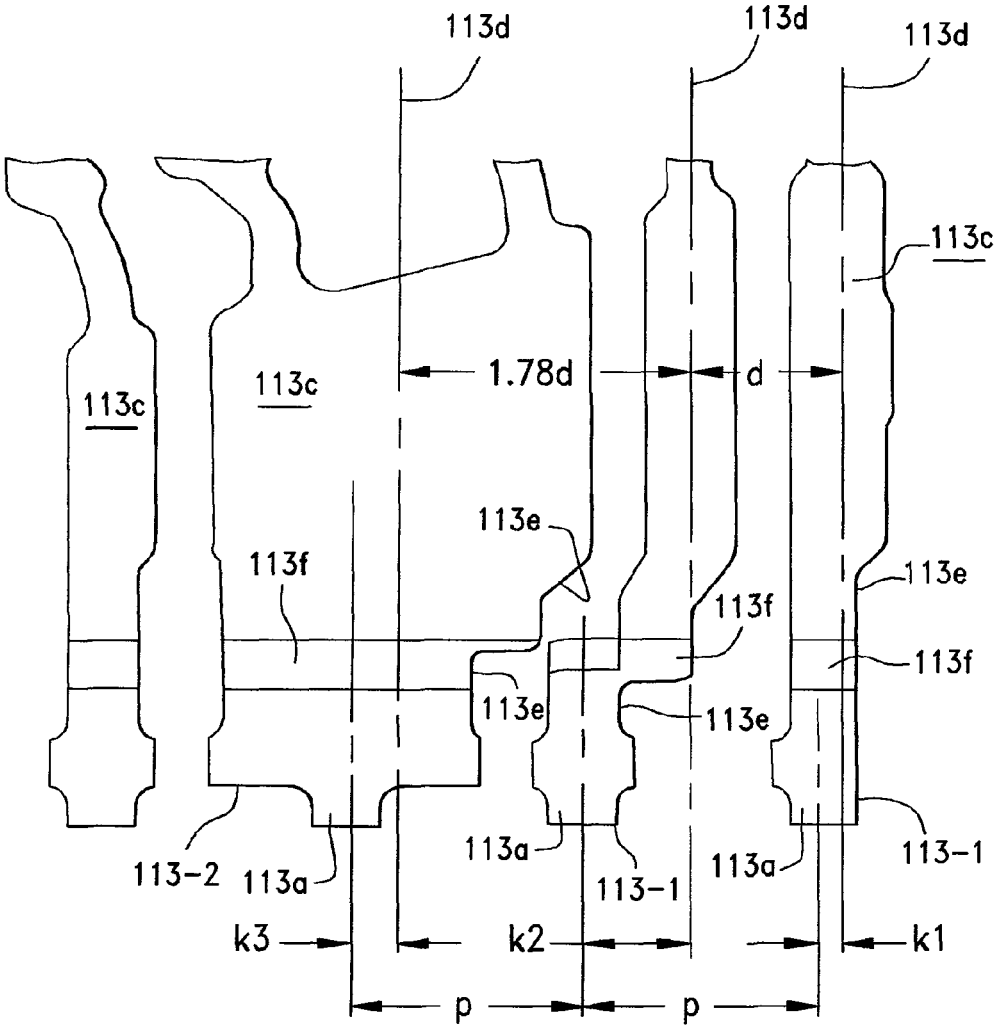
FIG. 18 is an enlarged detail diagrammatic view of the area where the terminal body portions meet the tail portions of the connectors of the invention, illustrating the lateral offset of the mounting tails in one column of signal pair and ground terminals.

Turning now to FIGS. 14-18, and in accordance with an important aspect of the invention, the body portions 113*c* of the ground and signal terminals 113-1 and 113-2 have irregular coplanar shapes which permit the tail portions 113*a* of the signal and ground contacts 113-1 and 113-2 to be disposed with a uniform pitch, while enabling the above-described positional relationship of differential signal pairs of terminals 113-1 in facing relation to a respective larger ground terminal 113-2 in an adjacent column of an opposing connector unit half. It can be seen that the body portions 113*c* of the signal and ground terminals 113-1, 113-2 of each column of terminals are aligned in coplanar relation to each other with the body portions of the terminals in one column of each connector unit being half disposed a uniform predetermined distance "t" with respect to the body portions of the terminals of the other column of the connector unit half (FIGS. 7B and 15). This distance t is the separation distance between the terminals of opposing connector wafers. Because the ground terminals 113-2 have a greater lateral width than the signal terminals 113-1, longitudinal center lines 113*d* of the body portions 113*c* of the signal and ground terminals 113-1, 113-2 do not have equal spacing (FIG. 18). Indeed, as shown in FIG. 18, the spacing between longitudinal center lines 113*d* of the body portions 113*c* of the signal terminals 113-1 is a distance "d", while the spacing between the longitudinal centerlines 113*d* of the body portions 113*c* of a signal contact 113-1 and an adjacent ground contact 113-2 is 1.78 d.

In keeping with the invention, notwithstanding non-uniform spacing of the center lines 113*d* of body portions 113*c* of the signal and ground terminals 113-1, 113-2, the mounting tail portions 113*a* of the ground and signal contacts are disposed in a uniform array of columns and rows for more versatile and efficient usage. To this end, the tail portions 113*a* of the signal and ground terminals 113-1, 113-2 are laterally offset from the respective longitudinal center line 113*d* of the terminal by predetermined different distances, and the signal and ground contacts 113-1, 113-2 are formed with recesses or necks that facilitate mounting of the terminals in laterally nested relation to each other where necessary a uniform spacing or pitch between the tail portions 113*a* of the terminals of each column. This uniform spacing can be a square spacing, or a preferred rectangular spacing. In the illustrated embodiment, as viewed in FIG. 18, it can be seen that the signal terminal 113-1 on the far right-hand side, as viewed in FIG. 18, is laterally offset a relatively small distance "k1" from a longitudinal center line 113-*d* of the terminal, while the tail portion 113*c* of the other signal terminal 113-1 of the differential pair is offset a greater distance "k2" from the center line 113*d* of the body portion 113*c* of the terminal, and the tail portion 113*a* of the ground terminal 113-2 is offset a distance "k3" from the center line 113*d* of the ground terminal. In this instance, the lateral offset distance "k3" of the ground contact 113-2 is less than the lateral offset distance "k2" of the adjacent signal terminal and greater than the lateral offset distance "k1" of the other signal terminal of the differential signal pair.

To facilitate positioning of the tail portions with such uniform pitch, each of the signal and ground terminals 113-1, 113-2 in this case is formed with a lateral recess or neck 113*e* on a lateral or edge side thereof sufficient to permit the required offsetting and nesting of the tail portions 113*a*. In the embodiment shown in FIG. 18, for example, the ground terminal 113-2 is formed with a pair of recesses or necks 113*e* and the tail portion 113*a* of the adjacent signal terminal 113-1 is nested within one of the recesses 113*e* in underlying relation to the body portion 113*c* of the ground terminal 113-2. As will be understood by one skilled in the art, the extent of such recessing or necking of the terminals 113-1, 113-2 can be effected in a manner that maintains proper impedance control of the signal terminals of each different signal pair as they extend through the dielectric mounting frames of the connector unit halves.

In keeping with a further aspect of the invention, the tail portions 113*a* of each column of signal and ground contacts 113-1, 113-2 are separated from the tail portions 113*a* of an adjacent column of terminals by a uniform transverse spacing different than the transverse spacing between the body portions 113*c* of the terminals of each connection unit. In the illustrated embodiment, the tail portion 113*a* of each signal and ground terminal 113-1, 113-2 is supported by a transverse, substantially horizontal flange portion 113*f* (FIGS. 15 and 18) that extends from the body portion 113*c* in diverging relation the terminals of the opposing connector unit half, such that the tail portions 113*a* of each column of signal and ground terminals have a transverse spacing "t1" greater than the transverse spacing "t" between the body portions 113*c* of the ground and signal terminals of the counter unit. (FIG. 15). The tail portions 113*c* of the signal and ground terminals of the opposing connector unit halves also are disposed with the same transverse spacing t1 to the columns of tail portions of the ground and signal terminals in the immediately adjacent connector units.

Hence, it can be seen that the tail portions 113*a* of the ground and signal terminals of the connector units are disposed in a uniform array, comprising equally spaced columns of tail portions 113*a* with the tail portions of each column also being equally spaced. In the illustrated embodiment, the tail portions of each column of terminals are spaced by a pitch "p" of 1.35 mm, and the columns of tail portions are spaced by a transverse spacing "t1" of 1.90 mm. These spacings yield an aspect ratio of about 0.71 and the widthwise spacing; t1 (also equal to WW rectified above) is about the smallest that can be achieved in via spacing on a printed circuit board to utilize the connector is mounted.

While the preferred embodiment of the invention have been shown and described, it will be apparent to those skilled in the art that changes and modifications may be made therein without departing from the spirit of the invention, the scope of which is defined by the appended claims.

We claim:

1. A connector assembly for use in high speed applications, comprising:

an insulative housing having a plurality of passages, the passages being arranged in columns and rows;

at least one connector unit disposed in the housing, the connector unit including an insulative support frame supporting two columns of conductive terminals in spaced-apart fashion, the support frame including a base member extending along a mounting face of the connector unit and a front member extending at an angle to the base member, the front member extending along a rear of the housing;

the terminals including tail portions for mounting to a circuit board, contact portions for mating with an opposing connector and body portions interconnecting the terminal tail and contact portions together, the terminals being divided into sets of differential signal terminal pairs and associated ground terminals, the differential signal terminals pairs being aligned edge-to-edge within each of the two columns, the differential signal terminal pairs being separated from each other within each column by single ground terminals, wherein the ground terminal in each of the two columns faces a differential signal terminal pair in the other of the two columns, each of the ground terminals having a first width that is substantially greater than a second width associated with the differential signal terminal pair the ground terminal faces, the edges of the ground terminal in adjacent columns overlapping each other so that the ground terminals cooperatively act electrically as a single ground within each of the connector units; the ground terminals in one column are electrically connected to at least one ground terminal in the other column.

2. The connector of claim 1, wherein the first width is at least 200% of the second width.

3. The connector of claim 2, wherein the first width is at least 230% of the second width.

4. The connector of claim 1, wherein the support frame includes a plurality of insulative ribs that extend adjacent to and behind the ground terminals from the support frame base member to the support frame front member.

5. The connector of claim 4, wherein the support frame ribs have a third width that is less than the first width.

6. The connector of claim 1, wherein the ground terminals overlap each other at least 10% of the width of the ground terminal.

7. The connector of claim 6, wherein the ground terminals overlap each other at least 15% of the ground terminal width.

8. The connector of claim 1, wherein at least one ground terminal in each column is electrically connected to two ground terminals in the other column.

9. A connector assembly for use in high speed applications, comprising:

an insulative housing having a plurality of passages, the passages being arranged in columns and rows;

at least one connector unit disposed in the housing, the connector unit including an insulative support frame supporting two columns of conductive terminals in spaced-apart fashion, the support frame including a base member extending along a mounting face of the connector unit and a front member extending at an angle to the base member, the front member extending along a rear of the housing; and the terminals including tail portions for mounting to a circuit board, contact portions for mating with an opposing connector and body portions interconnecting the terminal tail and contact portions together, the terminals being divided into sets of differential signal terminal pairs and associated ground terminals, the differential signal terminals pairs being aligned edge-to-edge within each of the two columns, the differential signal terminal pairs being separated from each other within each column by single ground terminals, wherein the ground terminal in each of the two columns faces a differential signal terminal pair in the other of the two columns, each of the ground terminals having a first width that is substantially greater than a second width associated with the differential signal terminal pair the ground terminal faces, the edges of the ground terminal in adjacent columns overlapping each other so that the ground terminals cooperatively act electrically as a single ground within each of the connector units and wherein the ground terminals in one column include contact tabs extending outwardly therefrom, the tabs configured to make contact with the ground terminals of the other column.

10. The connector of claim 1, wherein the ground terminals in the one terminal column are contacted to the ground terminals of the other terminal column proximate to the support frame front member.

11. The connector of claim 10, wherein the ground terminals in the one terminal column are additionally contacted to the ground terminals of the other terminal column proximate to the support frame base member.

12. A connector assembly for use in high speed applications, comprising:

an insulative housing having a plurality of passages, the passages being arranged in columns and rows;

at least one connector unit disposed in the housing, the connector unit including an insulative support frame supporting two columns of conductive terminals in spaced-apart fashion, the support frame including a base member extending along a mounting face of the connector unit and a front member extending at an angle to the base member, the front member extending along a rear of the housing; and the terminals including tail portions for mounting to a circuit board, contact portions for mating with an opposing connector and body portions interconnecting the terminal tail and contact portions together, the terminals being divided into sets of differential signal terminal pairs and associated ground terminals, the differential signal terminals pairs being aligned edge-to-edge within each of the two columns, the differential signal terminal pairs being separated from each other within each column by single ground terminals, wherein the ground terminal in each of the two columns faces a differential signal terminal pair in the other of the two columns, each of the ground terminals having a first width that is substantially greater than a second width associated with the differential signal terminal pair the ground terminal faces, the edges of the ground terminal in adjacent columns overlapping each other so that the ground terminals cooperatively act electrically as a single ground within each of the connector units, wherein the support frame includes a plurality of insulative ribs that extend adjacent to and behind the ground terminals from the support frame base member to the support frame front member; and contact members extending from ground terminals of the one terminal column across a centerline of the connector unit into contact with ground terminals of the other terminal column.

13. The connector of claim 12, wherein the contact members are disposed on opposite sides of the ribs.

* * * * *